US005838097A

United States Patent [19]

Kasanuki et al.

[11] Patent Number: 5,838,097

[45] Date of Patent: Nov. 17, 1998

[54] IMAGE DISPLAY APPARATUS

[75] Inventors: Yuji Kasanuki, Isehara; Osamu Takamatsu, Atsugi; Tetsuya Kaneko, Yokohama; Masahito Niibe, Atsugi; Mitsutoshi Hasegawa, Yokohama; Hidetoshi Suzuki, Fujisawa, all of Japan

[73] Assignee: Canon Kabushiki Kaisha

[21] Appl. No.: 338,089

[22] Filed: Nov. 9, 1994

[30] Foreign Application Priority Data

| | | | |
|---|---|---|---|
| Nov. 9, 1993 | [JP] | Japan | 5-279364 |
| Nov. 11, 1993 | [JP] | Japan | 5-282421 |
| Nov. 8, 1994 | [JP] | Japan | 6-273606 |

[51] Int. Cl.[6] ..... H01J 1/02

[52] U.S. Cl. ..... 313/495; 313/309; 313/336; 313/310; 313/351; 315/366

[58] Field of Search ..... 313/495, 496, 313/497, 421, 422, 427, 3, 6, 309, 310, 336, 351; 315/366

[56] References Cited

U.S. PATENT DOCUMENTS

| | | | |
|---|---|---|---|
| 4,904,895 | 2/1990 | Tsukamoto et al. | 313/336 |
| 4,956,578 | 9/1990 | Shimizu et al. | 315/1 |
| 4,988,913 | 1/1991 | Kawauch et al. | 313/422 |
| 5,066,883 | 11/1991 | Yoshioka et al. | 313/309 |
| 5,155,416 | 10/1992 | Suzuki et al. | 315/366 |
| 5,170,092 | 12/1992 | Tomii et al. | 313/310 |
| 5,285,129 | 2/1994 | Takeda et al. | 313/103 |
| 5,308,439 | 5/1994 | Cronin et al. | 313/336 |
| 5,565,729 | 10/1996 | Faris et al. | 313/105 CM |
| 5,650,795 | 7/1997 | Banno et al. | 313/309 |

FOREIGN PATENT DOCUMENTS

| | | |
|---|---|---|
| 0131332 | 2/1989 | Japan . |
| 02257551 | 10/1990 | Japan . |
| 0355738 | 3/1991 | Japan . |
| 0428137 | 1/1992 | Japan . |

OTHER PUBLICATIONS

St. Regis Paper Co. vs. Bemi Co, Inc. USPQ 8,11 (7th Cor. 1977).

"Strong Electron Emission From Patterned Tin–Indium Oxide Thin Films" by M. Hartwell et al. iedm Technical Digest; Int'l Electron Devices Meeting, 1975, Washington, D.C.; pp. 519–521.

"Field Emission" by W.P. Dyke et al.; Advances in Electronics and Electron Physics, vol. VIII, 1956; pp. 89–185.

"Electron Conduction aned Electron Emission of Discontinuous Thin Films" by G. Dittmer; Thin Solid Films, 9, 1972 pp. 317–328.

"Operation of Tunnel–Emission Devices" by C.A. Mead. Journal of Applied Physics; vol. 32, No. 4, Apr., 1961; pp. 646–652.

"Physical properties of thin–filmfield emission cathodes with molybdenum cones" by C.A. Spindt et al.; Journal of Applied Physics; vol. 47, No. 12 Dec., 1976 pp. 5248–5263.

"Emission of Hot Electrons and The Field Emission Of Electrons From Tin Oxide" by M.I. Elinson et al. Radio Engineering and Electronic Physics; Jul. 1965 pp. 1290–1296.

"Electroforming and Electron Emission of Carbon Thin Films" Hisashi Araki et al. Journal of the VacuumSociety of Japan; vol. 26, No. 1, pp. 22–29.

*Primary Examiner*—Sandra L. O'Shea
*Assistant Examiner*—Joseph Williams
*Attorney, Agent, or Firm*—Fitzpatrick, Cella, Harper & Scinto

[57] ABSTRACT

An image display apparatus comprises a plurality of electron-emitting devices and an image-forming member for forming an image upon irradiation of electron beams emitted from the electron-emitting devices. The apparatus further comprises a plurality of substrates having the electron-emitting devices arrayed thereon and being arranged side by side, and a deviating unit for deviating the electron beams emitted from the electron-emitting devices arrayed on the substrates. The deviating unit deviates the electron beams toward the boundary between the substrates. When the plurality of substrates are combined with each other to provide the image forming apparatus having a large-sized screen, a display incapable region is prevented from appearing at the boundary between the substrates.

20 Claims, 27 Drawing Sheets

IMAGE DISPLAY APPARATUS

BACKGROUND OF THE INVENTION

1. Field of the Invention

The present invention relates to a planar display apparatus having a large-sized screen, and more particularly to a display apparatus newly designed to increase the screen size of a planar CRT which employs electron-emitting devices and fluorescent substances.

2. Related Background Art

Heretofore, two types of electron-emitting devices are known; i.e., a thermionic cathode device and a cold cathode device. Cold cathode devices include electron-emitting devices of surface conduction type, field emission type (hereinafter abbreviated to FE), metal/insulating layer/metal type (hereinafter abbreviated to MIM), etc.

One example described in, e.g., M.I. Elinson, Radio Eng. Electron Phys., 10, 1290, (1965) and other later-described examples are known as surface conduction electron-emitting devices.

A surface conduction electron-emitting device utilizes a phenomenon that when a thin film having a small area is formed on a substrate and a current is supplied to flow parallel to the film surface, electrons are emitted therefrom. As to such a surface conduction electron-emitting device, there have been reported, for example, one using a thin film of $SnO_2$ by Elinson cited above, one using an Au thin film [G. Dittmer: "Thin Solid Films", 9, 317 (1972)], one using a thin film of $In_2O_3/SnO_2$ (M. Hartwell and C. G. Fonstad: "IEEE Trans. ED Conf.", 519 (1975), and one using a carbon thin film (Hisashi Araki et. al.: "Vacuum", Vol. 26, No. 1, 22 (1983).

As a typical configuration of those surface conduction electron-emitting devices, FIG. 31 shows a plan of the device proposed by M. Hartwell in the above-cited paper. In FIG. 31, denoted by reference numeral 3001 is a substrate and 3004 is a conductive thin film made of a metal oxide formed by sputtering. As shown, the conductive thin film 3004 is formed into an H-shaped pattern in plan view. The conductive thin film 3004 is subjected to the energizing process called forming by energization (described later) to form an electron-emitting region 3005. The dimensions indicated by L and W in the drawing are set to 0.5–1 mm and 0.1 mm, respectively. Although the electron-emitting region 3005 is shown as being rectangular centrally of the conductive thin film 3004, the region 3005 is illustrated so only for the convenience of drawing and does not exactly represent the actual position and shape thereof.

In those surface conduction electron-emitting devices, including the one proposed by M. Hartwell, et. al., it has heretofore been customary that, before starting emission of electrons, the conductive thin film 3004 is subjected to the energizing process called forming by energization to form the electron-emitting region 3005. The term "forming by energization" means a process of applying a DC voltage being constant or rising very slowly at a rate of, for example, 1 V/minute, across the conductive thin film 3004 to locally destroy, deform or denature it to thereby form the electron-emitting region 3005 which has been transformed into an electrically high-resistance state. There is produced a fissure in a portion of the conductive thin film 3004 which has been locally destroyed, deformed or denatured. When an appropriate voltage is applied to the conductive thin film 3004 after the forming by energization, electrons are emitted from the vicinity of the fissure.

Examples of FE electron-emitting devices are described in, e.g., W. P. Dyke & W. W. Dolan, "Field Emission", Advance in Electron Physics, 8, 89 (1956) and C. A. Spindt, "Physical properties of thin-film field emission cathodes with molybdenum cones", J. Appl. Phys., 47, 5248 (1976).

As one typical configuration of the FE devices, FIG. 32 shows a section of the device proposed by C. A. Spindt. In FIG. 32, denoted by reference numeral 3010 is a substrate, 3011 is an emitter wiring made of any suitable conductive material, 3012 is an emitter cone, 3013 is an insulating layer, and 3014 is a gate electrode. When an appropriate voltage is applied between the emitter cone 3012 and the gate electrode 3014, this device emits electrons from the tip end of the emitter cone 3012.

Other than the laminated structure shown in FIG. 32, there is also known another configuration of the FE devices in which an emitter and a gate electrode are arranged side by side on a substrate substantially parallel to the substrate plane.

One example of MIM electron-emitting devices is described in, e.g., C. A. Mead, "Operation of tunnel-emission devices", J. Appl. Phys., 32, 646 (1961). One typical configuration of the MIM devices is shown in a sectional view of FIG. 33. In FIG. 33, denoted by reference numeral 3020 is a substrate, 3021 is a lower electrode made of metal, 3022 is a thin insulating layer being about 100 angstroms thick, and 3023 is an upper electrode made of metal and being about 80–300 angstroms thick. When an appropriate voltage is applied between the upper electrode 3023 and the lower electrode 3021, this MIM device emits electrons from the surface of the upper electrode 3023.

The above-described cold cathode devices can emit electrons at a lower temperature than needed in thermionic cathode devices, and hence require no heaters for heating the devices. Accordingly, the cold cathode devices are simpler in structure and can be formed in a finer pattern than thermionic cathode devices. Further, even when a number of cold cathode devices are arrayed on a substrate at a high density, the problem of hot-melting the substrate is less likely to occur. Additionally, unlike thermionic cathode devices that have a low response speed because they operate under heating by heaters, the cold cathode devices are also advantageous in having a high response speed.

For that reason, intensive studies have been focused on applications of the cold cathode devices.

Of the cold cathode devices, particularly, the surface conduction electron-emitting device is simple in structure and easy to manufacture, and hence has an advantage that a number of devices can be formed into an array having a large area. Therefore, methods of arraying a number of devices and driving them have been studied as disclosed in, e.g., Japanese Patent Appln. Laid-Open No. 64-31332 filed by the applicant.

Various applications of surface conduction electron-emitting devices have also been studied in the fields of image display apparatus such as image display apparatuses and image recording apparatuses, charged beam sources, and so on.

As an application to image display apparatuses, particularly, one employing a combination of a surface conduction electron-emitting device and a fluorescent substance which emits light upon irradiation of an electron beam has been researched as disclosed in, e.g., U.S. Pat. No. 5,066,883 and Japanese Patent Laid-Open Appln. No. 2-257551 and No. 4-28137 all filed by the applicant. Such an image display apparatus employing the combination of a surface conduction electron-emitting device and a fluorescent substance is expected to have superior characteristics to other conventional image display apparatuses. As compared with display apparatuses using liquid crystals which have recently become popular, for example, the above combined display apparatus is superior in that it does not require any backlight because of being self-luminous and has a wider field angle of vision.

One of methods of arraying a number of FE devices and driving them is disclosed in, e.g., U.S. Pat. No. 4,904,895 filed by the applicant. As an application example of FE devices to an image display apparatus, there is known a flat display apparatus reported by R. Meyer, for example. [R. Meyer : "Recent Development on Microtips Display at LETI", Tech. Digest of 4th Int. Vacuum Microelectronics Conf., Nagahama, pp. 6–9 (1991)]

One example in which an array of numerous MIN devices is applied to an image display apparatus is disclosed in, e.g., Japanese Patent Laid-Open Appln. No. 3-55738 filed by the applicant.

The inventors have attempted manufacture of cold cathode devices by using a variety of materials, methods and structures, including the ones described above as the prior art. Also, the inventors have studied a multi-electron beam source having an array of numerous cold cathode devices, and an image display apparatus in which the multi-electron beam source is employed.

For example, the inventors have tried a multi-electron beam source using an electrical wiring method as shown in FIG. 34. Specifically, the multi-electron beam source is arranged such that a number of cold cathode devices are arrayed two-dimensionally and wired into a matrix pattern as shown.

In FIG. 34, denoted by 4001 is a cold cathode device symbolically shown, 4002 is a row-directional wiring, and 4003 is a column-directional wiring. While the row- and column-directional wirings 4002, 4003 have in fact infinitive electric resistances, these resistances are indicated as wiring resistors 4004, 4005 in the drawing. This wiring method will be referred to as a simple matrix wiring.

FIG. 34 shows a 6×6 matrix for the convenience of drawing. However, the matrix size is not of course limited to the illustrated one. For example, a multi-electron beam source for an image display apparatus is formed by arraying and wiring cold cathode devices in number enough to provide desired image display.

In a multi-electron beam source having cold cathode devices of the simple matrix wiring, appropriate electric signals are applied to the row-directional wirings 4002 and the column-directional wirings 4003 for emitting desired electron beams. To drive any one row of cold cathode devices in the matrix, a select voltage Vs is applied to the row-directional wiring 4002 to be selected and, simultaneously, a non-select voltage Vns is applied to the other row-directional wirings 4002 to be not selected. In synch with application of the voltages to the row-directional wirings 4002, a drive voltage Ve for enabling the devices to emit electron beams is applied to the column-directional wirings 4003. With this method, ignoring voltage drops through the wiring resistances 4004 and 4005, the voltage Ve–Vs is applied to the cold cathode devices in the selected row and the voltage Ve–Vns is applied to the cold cathode devices in the non-selected rows. If the voltages Ve, Vs and Vns are set to have suitable values, electron beams are emitted with the desired intensity only from the cold cathode devices in the selected row. Also, if the drive voltage Ve applied to the column-directional wiring 4003 is set to have respective different values, electron beams are emitted with the different intensities from the individual cold cathode devices. Further, if the duration in which the drive voltage Ve is applied is changed, the period of time in which the electron beam is emitted can also be changed.

Accordingly, the multi-electron beam source having cold cathode devices of the simple matrix wiring is applicable to various fields. For example, that multi-electron beam source can be suitably used as an electron source for an image display apparatus by properly applying electric signals to the cold cathode devices in accordance with image information.

On the other hand, with rapid development of an information-oriented society, there is an increasing demand for a larger display screen and higher resolution in the field of image display apparatuses regardless of whether they are used for domestic or industrial purpose.

For the image display apparatus employing cold cathode devices, realizing a larger display screen and higher resolution is also desired.

However, it is difficult to realize a larger display screen and higher resolution simultaneously for the reason as follows.

In order to obtain a display screen with a diagonal length of several tens inches, for example, a multi-electron beam source must be used in which a number of cold cathode devices are formed and wired on a commensurately large substrate at the same array pitch as the array pitch of display pixels. Manufacturing such a multi-electron beam source on a single substrate is however difficult from the standpoints of accuracy, yield and manufacturing cost.

For example, while the vacuum film-forming technique known in the fields of IC manufacture, etc. is generally used as a film-forming technique in the process of manufacturing the multi-electron beam source, the film-forming apparatus corresponding to a large-area substrate must be large in scale and hence requires a great amount of equipment investment. In addition, there gives rise to a technical difficulty in forming a homogeneous film over a large area.

Further, while the photolithography/etching technique known in the fields of IC manufacture, etc. is generally used as a patterning technique in the process of manufacturing the multi-electron beam source, the exposure apparatus required for the patterning technique must be also large in scale and hence requires a great amount of equipment investment. When the method of subjecting a large area to exposure at a time is employed, other problems arise in that a patterning resolution is deteriorated in peripheral regions of the screen due to optical limits (such as aberration), and an large-area exposure mask becomes very expensive. Alternatively, when the method of dividing an entire large area into plural small areas and subjecting the small areas to exposure successively is employed, a considerable time is required to complete the process for the entire area, resulting in problems of needing the increased number of exposure apparatus and increasing the production cost.

To solve the above-mentioned problem, it is envisaged to combine a plurality of small-area substrates, each having cold cathode devices formed thereon beforehand, with each other to construct a large-area multi-electron beam source. According to this method, since film-forming and patterning can be performed in a small area, the manufacture apparatus can be avoided from problems of increasing the size and lowering the accuracy. Also, since only good substrates can be selected and combined with each other by removing failed substrates beforehand, resources wasted upon the occurrence of failed substrates can be reduced as compared with the case of using large-area substrates.

However, the multi-electron beam source utilizing the above method has a critical problem when applied to an image display apparatus.

To describe the problem in detail, a section of one example of image display apparatuses utilizing the above multi-electron beam source is shown in FIG. 35A.

Referring to FIG. 35A, denoted by 4010A and 4010B are separate substrates joined to each other at a seam 4011. A number of cold cathode devices 4001 are formed on each of the substrates 4010A and 4010B. 4012 is a substrate as a face plate of the image display apparatus with fluorescent substances 4013 disposed on its inner surface. Thus, the illustrated image display apparatus is of a self-luminous (or emission-type) device capable of emitting visible light upon electron beams $e^-$, emitted from the cold cathode devices 4001, irradiating the fluorescent substances 4013.

Assuming, for example, that pixels are required to be arrayed at a pitch Px in the X-direction to provide the image display apparatus with a desired resolution, the fluorescent substances 4013 are required to be arranged on the face plate 4012 at the same pitch Px over the entire display region. Further, an array pitch PAx of the cold cathode devices on the substrate 4010A is selected to be equal to Px. Likewise, an array pitch PBx of the cold cathode devices on the substrate 4010B is also selected to be equal to Px.

FIG. 35B is a plan view of the substrates on which the cold cathode devices are arrayed. Due to limits in manufacturing, it is very difficult to form the cold cathode devices in a region up to a certain distance Ld from the end of each substrate (i.e., in a portion C surrounded by dotted lines in FIG. 35B). The reasons are that a film-forming material and an etchant are more likely to distribute unevenly within the certain distance from the substrate end during the steps of film-forming and patterning, that a film tends to easily peel off in the substrate end, and that some space is necessary to hold the substrate for fixing and carrying it. The value of the distance Ld cannot be uniquely determined because it depends on a thickness of the substrate and a capability of the manufacture apparatus employed. Generally speaking, however, the distance value is large as compared with the pixel pitch that is desired for image display apparatuses with screens having a diagonal length of several tens inches.

The above-mentioned difficulty in forming the cold cathode devices in end regions of the substrates near the seam 4011 therebetween (i.e., in the portion C surrounded by dotted lines in the drawings) gives rise to a problem that a display incapable region (i.e., a portion D surrounded by dotted lines in FIG. 35A) is produced in the display apparatus of FIG. 35A. In the display incapable region, even if the fluorescent substances 4013 (indicated by black squares in FIG. 35A) are disposed there, no electron beams are irradiated to those fluorescent substances and an image cannot be displayed. Accordingly, even if an image display apparatus having a large-sized screen is manufactured, a stripe- or grid-shaped display incapable region appears in the screen at a position corresponding to each seam between the substrates, resulting in a considerable deterioration of image quality.

SUMMARY OF THE INVENTION

With a view of solving the problems described above, an object of the present invention is to provide a novel image display apparatus using a plurality of substrates with electron-emitting devices formed on each of the substrates, wherein the image display apparatus includes means for preventing a display incapable region from appearing at the boundary between the substrates.

To achieve the above object, according to the present invention, there is provided an image display apparatus comprising a plurality of electron-emitting devices and an image-forming member for forming an image upon irradiation of electron beams emitted from the electron-emitting devices, wherein the apparatus further comprises a plurality of substrates having the electron-emitting devices arrayed thereon and being arranged side by side, and deviating means for deviating the electron beams emitted from the electron-emitting devices arrayed on the substrates, the deviating means deviating the electron beams toward the boundary between the substrates.

DESCRIPTION OF THE PREFERRED EMBODIMENTS

The present invention is concerned with an image display apparatus comprising a large-area multi-electron beam source comprised of a plurality of substrates each having electron-emitting devices formed thereon and combined with each other, and fluorescent substances, wherein an electron beam emitted from the electron-emitting device toward the corresponding fluorescent substance is controlled so as to deviate an appropriate distance toward the boundary between the substrates before impinging upon the fluorescent substance, thereby preventing a display incapable region from appearing.

While the control method of the present invention is applicable to the case of combining any number of substrates with each other, it will first be described below in connection the case of combining two substrates with each other for the convenience of description by referring to FIGS. 1A to 2B.

Figure 1A:
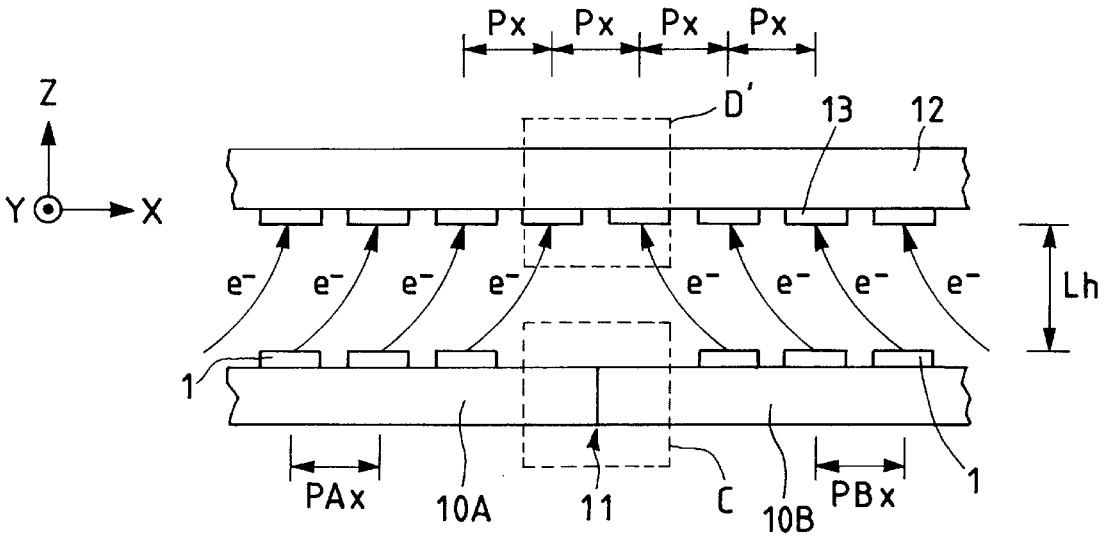
FIG. 1A is a sectional view for explaining the basic concept of the present invention.

FIG. 1A is a sectional view for explaining the principle of the present invention. In FIG. 1A, denoted by 10A and 10B are independent substrates each having electron-emitting devices 1 formed on its upper surface. The structure and arrangement of the electron-emitting devices 1 formed on the substrate surface, and the method of applying drive voltages to the electron-emitting devices 1 will be described later. The substrates 10A and 10B are joined to each other at a boundary 11 therebetween. For the reason described before, no electron-emitting devices are formed in a portion C surrounded by dotted lines near the boundary 11. Also, denoted by 12 is a substrate as a face plate with fluorescent substances 13 disposed on its inner surface.

In the present invention, an electron beam emitted from the electron-emitting device 1 is controlled in its path while flying toward the face plate 12 such that it does not linearly fly in the Z-direction, but it is deviated in the direction toward the boundary 11 while travelling in the Z-direction, as shown. More specifically, in the example of FIGS. 1A and 1B, electron beams emitted from the electron-emitting devices on the substrate 10A are deviated in the X-direction while traveling in the Z-direction, and electron beams emitted from the electron-emitting devices on the substrate 10B are deviated in a direction 180°-opposed to the X-direction while traveling in the Z-direction. Therefore, electron beams can be irradiated to even a region (i.e., a portion D' surrounded by dotted lines in FIG. 1A) which could not receive irradiation of electron beams in the prior art. Assuming that the array pitch of pixels in the X-direction is Px, the array pitch PAx of the electron-emitting devices on the substrate 10A and the array pitch PBx of the electron-emitting devices on the substrate 10B are set to be equal to Px, i.e., PAx=PBx=Px.

A description will now be given of two preferable measures (embodiments of electron beam deviation control) for realizing the method of flying electron beams, explained above in connection with FIG. 1A, according to the present invention. The first measure will first be described with reference to FIG. 1B, FIGS. 2A and 2B as well as FIGS. 3A and 3B, followed by the second measure with reference to FIG. 4.

(First Measure)

The first measure is featured in a manner in which the electron-emitting devices are arranged on the substrates.

Figure 1B:
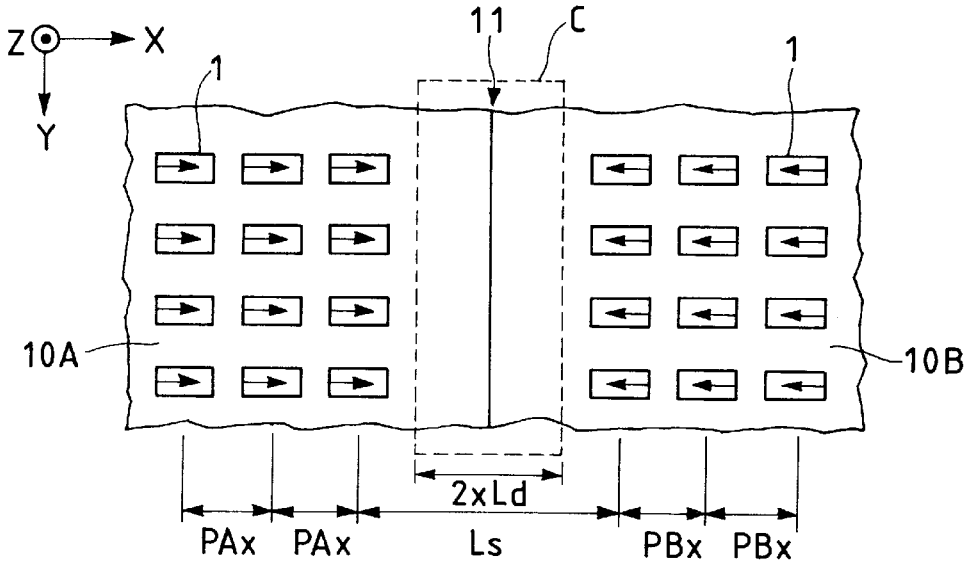
FIG. 1B is a plan view showing a first measure of the present invention.

FIG. 1B is a plan view of the substrates 10A and 10B having the electron-emitting devices formed thereon. As described above, the array pitches of the electron-emitting devices on the substrates with respect to the X-direction are set to PAx=PBx=Px. The spacing Ls between the electron-emitting devices spaced through a section including the boundary 11 between the substrates 10A and 10B is of course larger than Px and is set to be larger than twice Ld mentioned above in connection with the problem to be solved by the present invention. Note that Ls will be described later in more detail.

The electron-emitting devices 1 formed on the substrate 10A and the electron-emitting devices 1 formed on the substrate 10B are disposed in 180° opposed relation with respect to the X-direction. (In FIG. 1B, the direction of each electron-emitting device 1 is symbolically indicated by arrow. The direction of arrow represents the direction of a vector Ef described later.)

The construction shown in FIG. 1B will be described below in more detail.

The electron-emitting devices for use with the construction shown in FIG. 1B are selected to have the following characteristics. The selected electron-emitting devices each generate an asymmetrical potential distribution in a space around its electron-emitting region with respect to a normal line extending from the substrate plane to the surface of the fluorescent substance while passing the electron-emitting region under a driven state (i.e., a state where the drive voltage for emitting an electron beam is applied to the electron-emitting device).

Those electron-emitting devices will be described in more detail with reference to FIGS. 2A and 2B.

Figure 2A:
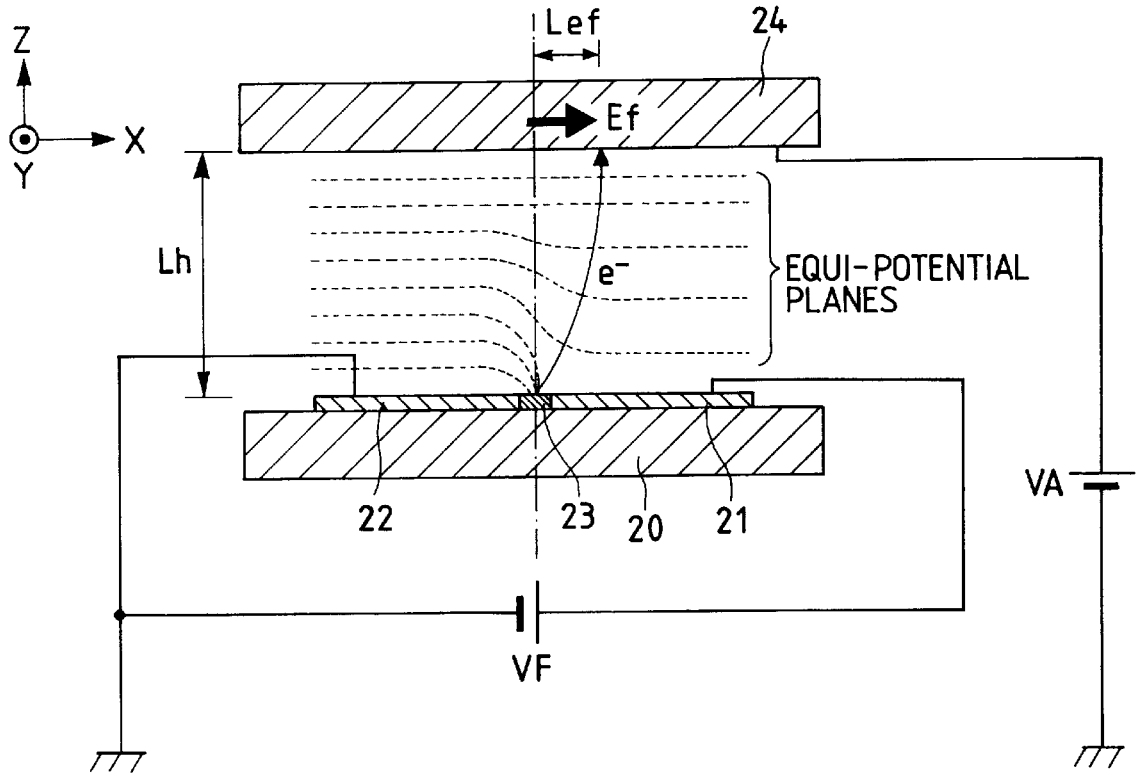
FIGS. 2A and 2B are views each showing the path of an electron beam.
Figure 2B:
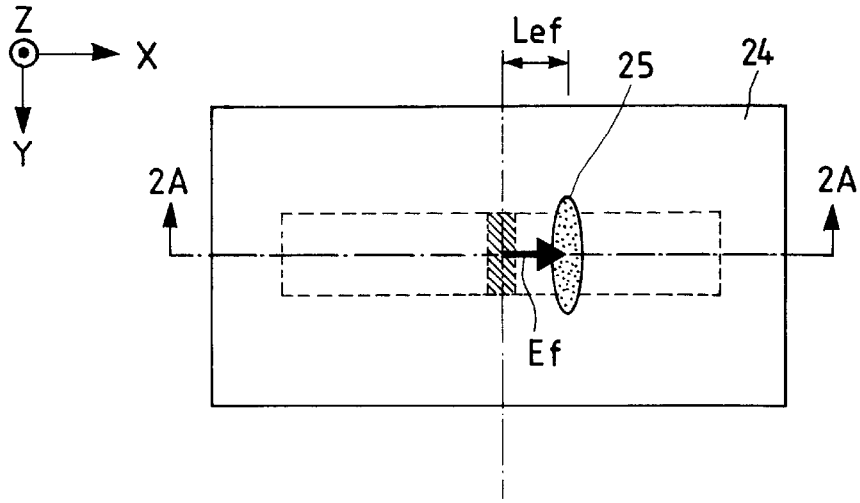

FIG. 2A is a sectional view for explaining the electron-emitting device used in the first measure of the present invention. In FIG. 2A, denoted by 20 is a substrate on which the electron-emitting device is disposed, 21 is a positive electrode of the electron-emitting device, 22 is a negative electrode of the electron-emitting device, 23 is an electron-emitting region of the electron-emitting device, 24 is an electron beam target, VF is a power supply for applying a drive voltage Vf [V] to the electron-emitting device, and VA is a power supply for applying a target voltage Va [V] to the target 24. (In an actual image display apparatus, the target 24 is formed of a fluorescent substance. Generally, there holds a relationship of Va>Vf.)

The electron-emitting device for use with the first measure of the present invention includes, as constituent members, at least the positive electrode 21, the negative electrode 22 and the electron-emitting region 23. These constituent members are formed side by side on an upper surface of the substrate 20. (In the following description, the upper surface of the substrate 20 will be referred to as substrate plane.)

Figure 31:
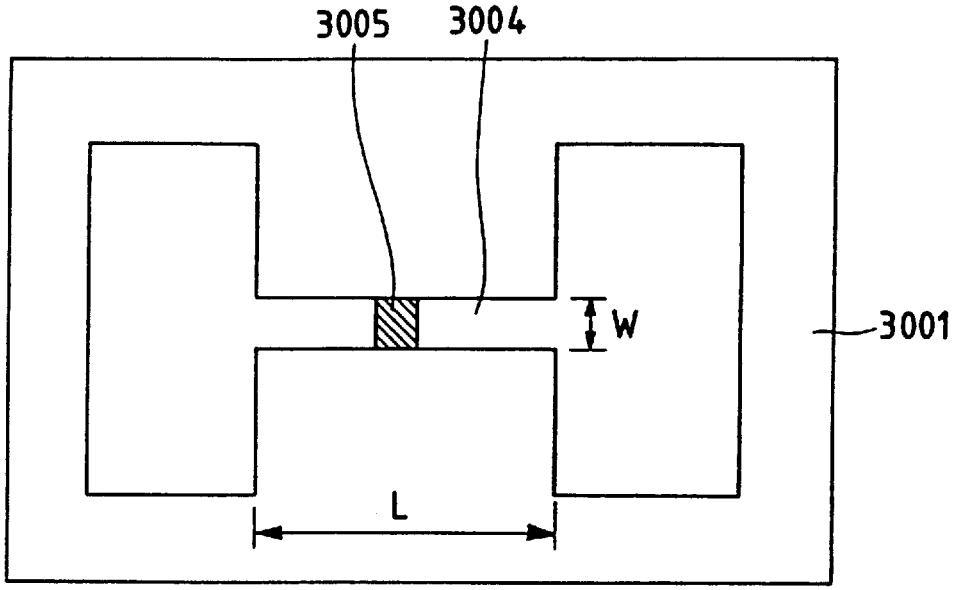
FIG. 31 PRIOR ART
FIG. 31 is a plan view showing one example of a conventionally known surface conduction electron-emitting device.
Figure 32:
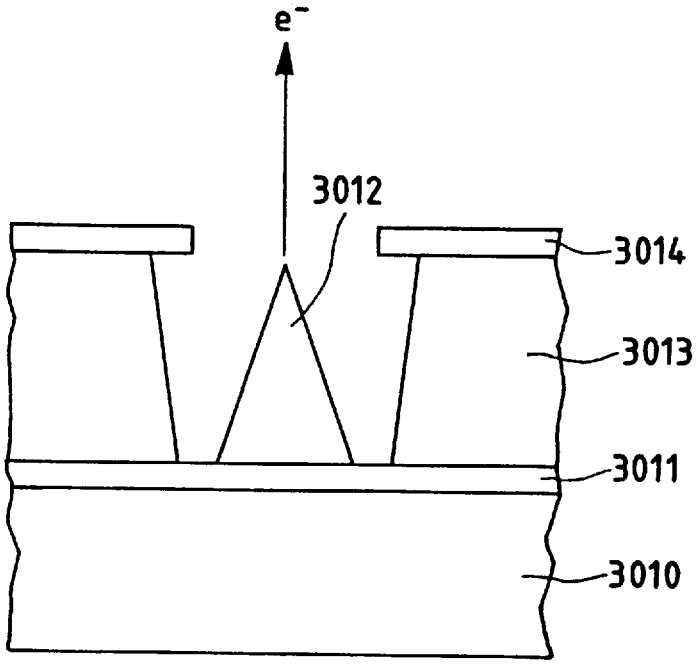
FIG. 32 PRIOR ART
FIG. 32 is a sectional view showing one example of a conventionally known FE electron-emitting device.
Figure 33:
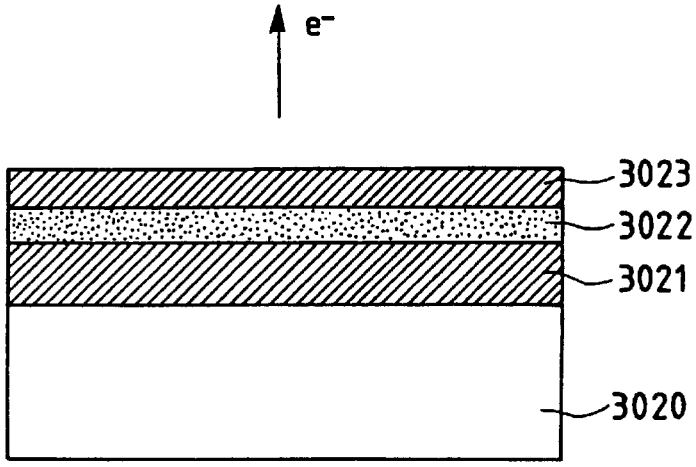
FIG. 33 PRIOR ART
FIG. 33 is a sectional view showing one example of a conventionally known MIM electron-emitting device.

For example, the electron-emitting devices shown in FIGS. 32 and 33 have their constituent members laminated on the substrate plane in the vertical direction, and hence they do not correspond to the above-mentioned type electron-emitting device in which the constituent members are arranged side by side on the substrate plane. On the other hand, the electron-emitting device shown in FIG. 31 corresponds to the above-mentioned type electron-emitting device.

In the electron-emitting device shown in FIG. 2A, an electron beam emitted from the electron-emitting region 23 generally has a component of initial velocity directing toward the positive electrode 21 from the negative electrode 22. Accordingly, the electron beam does not travel perpendicularly to the substrate plane.

In addition, for that electron-emitting device, since the positive electrode 21 from the negative electrode 22 are disposed on the substrate plane side by side, the potential distribution created in a space above the electron-emitting region 23 upon application of the drive voltage becomes asymmetrical with respect to a line extending vertically to the substrate plane while passing the electron-emitting region 23 (i.e., a one-dot-chain line in FIG. 2A). The potential distribution between the electron-emitting device and the target 24 is indicated by dotted lines in FIG. 2A. As shown, while the equi-potential plane is substantially parallel to the substrate plane near the target 24, it is inclined under an effect of the drive voltage Vf [V] near the electron-emitting device. Therefore, the electron beam emitted from the electron-emitting region 23 is subjected to not only forces in the Z-direction, but also forces in the X-direction due to the inclined potential while it is flying through the space between the substrates. The resultant path of the electron beam is curved as shown.

For the above two reasons, the position where the electron beam irradiates the target 24 is deviated a distance Lef in the X-direction from the position on the target that is perpendicular to or just right above the electron-emitting region. FIG. 2B is a plan view of the target 24 as viewed from above. In FIG. 2B, an ellipse denoted by 25 symbolically represents the position irradiated by the electron beam on the underside of the target. (Note that FIG. 2A shows a vertical section of FIG. 2B.)

To represent in a general formula how the position irradiated by the electron beam is deviated from the position perpendicularly above the electron-emitting region on the target 24, the direction and distance of the resulting deviation are expressed by using the vector Ef for the sake of convenience.

First, it can be said that the direction of the vector Ef is the same as the direction in which the negative electrode, the electron-emitting region and the positive electrode of the electron-emitting device are arranged side by side on the substrate plane. In the case of FIG. 2A, for example, because the negative electrode 22, the electron-emitting region 23 and the positive electrode 21 of the electron-emitting device are successively arranged in the X-direction on the substrate 20 in this order, the vector Ef is pointed in the X-direction.

Figure 3A:
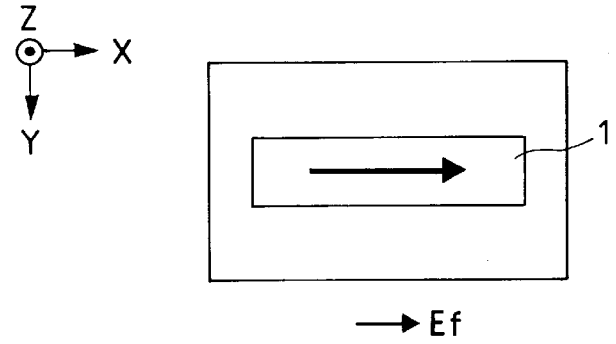
FIGS. 3A and 3B are schematic views each showing the direction in which an electron-emitting device is disposed.
Figure 3B:
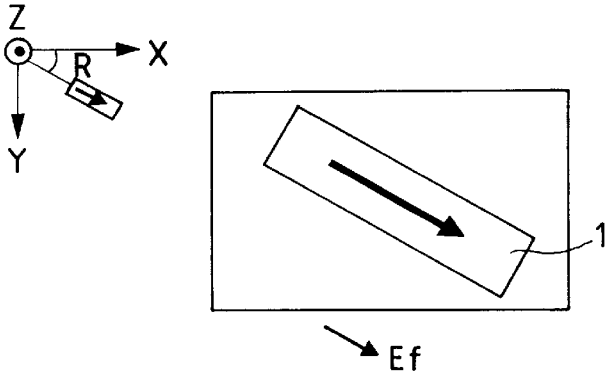

For the purpose of indicating the direction in which the electron-emitting device is formed on the substrate plane and the direction of the vector Ef on the drawing, it is assumed that those directions are symbolically indicated in such a manner as illustrated in FIGS. 3A and 3B. FIG. 3A shows an example in which the negative electrode, the electron-emitting region and the positive electrode of the electron-emitting device 1 are arranged on the substrate side by side in the X-direction, and FIG. 3B shows an example in which they are arranged on the substrate side by side in a direction inclined an angle R from the X-direction.

Then, the magnitude of the vector Ef (i.e., Lef) depends on the distance Lh between the electron-emitting device and the target, the drive voltage Vf applied to the electron-emitting device, the potential Va of the target, and the type and configuration of the electron-emitting device, but its approximate value can be calculated from the following equation [1]:

$$Lef = 2 \times K \times Lh \times \sqrt{Vf/Va} \quad [1]$$

where

Lh [m] is the distance between the electron-emitting device and the target,

Vf [V] is the drive voltage applied to the electron-emitting device,

Va [V] is the voltage applied to the target, and

K is the constant determined by the type and configuration of the electron-emitting device.

In calculating an approximate value from the equation [1], K=1 is put in the equation when the type and configuration of the electron-emitting device used is unknown.

When the type and configuration of the electron-emitting device is known, the constant K of the electron-emitting device is determined by experiments or simulation using a computer.

To determine Lef with higher accuracy, it is desired that K is set to be not a constant, but a function of Vf. In most cases, however, using a constant as K is sufficient for the accuracy required in design of image display apparatuses.

Referring to the above, the construction of FIG. 1B will be further described below.

The electron-emitting devices 1 are formed on the substrate 10A in the direction of R=0 degree. and the electron-emitting devices 1 are formed on the substrate 10B in the direction of R=180 degrees. Also, the distance Ls between the electron-emitting devices which are nearest to the boundary 11 between the two substrates in opposite relation to each other is set to a value determined by the following equation [2].

$$Ls = Px + (2 \times Lef) \quad [2]$$

where

Px is the array pitch of pixels, and

Lef is the distance determined by the equation [1].

As will be seen from the equations [1] and [2], Ls can be made sufficiently large by setting the appropriate conditions. In other words, according to the above-described first measure, the display incapable region is prevented from appearing with no need of forming the electron-emitting devices near the substrate ends.

The first measure for realizing the method of flying electron beams according to the present invention, shown in FIG. 1A, has been explained above.

(Second Measure)

The second measure for realizing the method shown in FIG. 1A will be described below with reference to FIG. 4. The second measure is featured in comprising deflection electrodes to deflect electron beams toward the boundary between the substrates.

Figure 4:
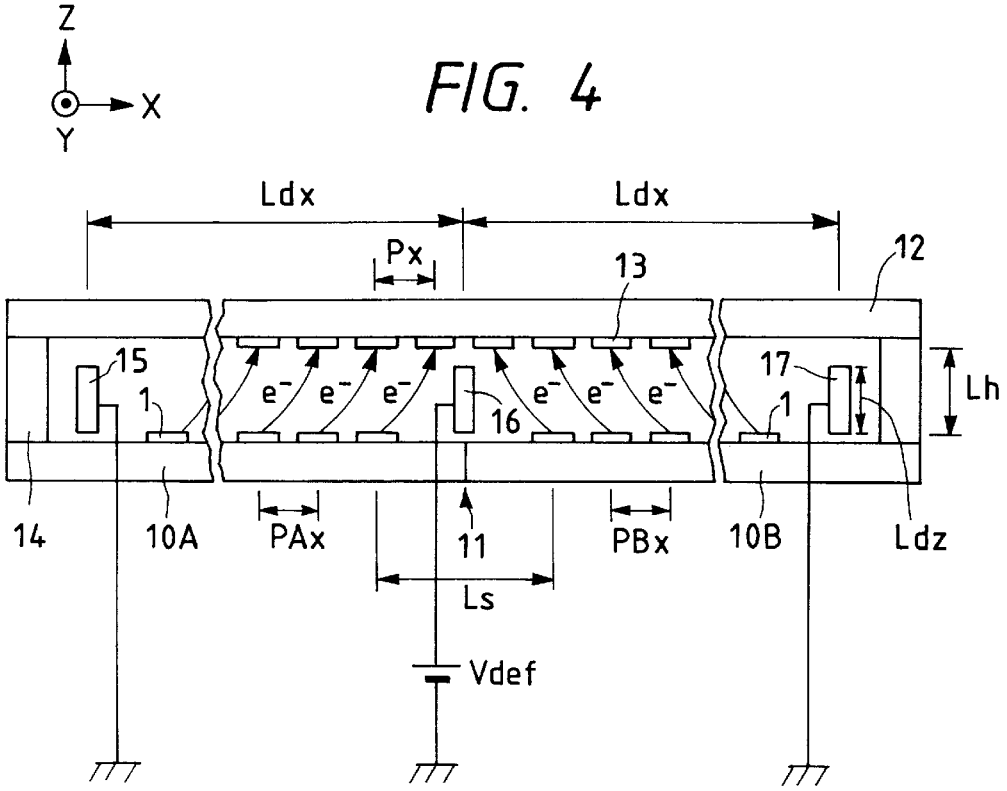
FIG. 4 is a sectional view showing a second measure of the present invention.
Figure 5A:
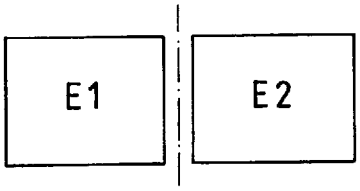
FIGS. 5A to 5D are plan views each showing a layout of electron source substrates in the present invention.
Figure 5B:
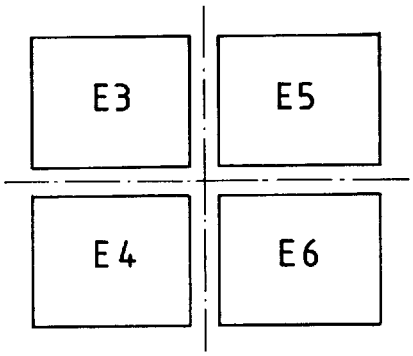
Figure 5C:
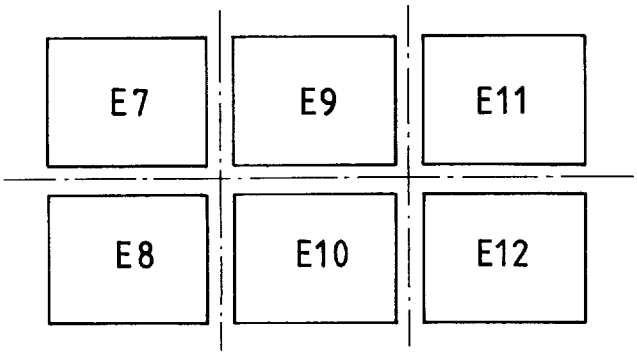
Figure 5D:
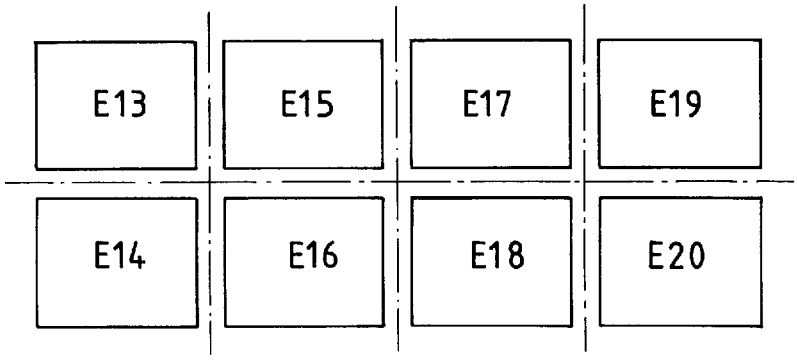

FIG. 4 shows a vertical section of an image display apparatus according to the second measure. In FIG. 4, parts common to those in FIG. 1A are denoted by the same reference numerals. Denoted by 14 is a side wall of the image display apparatus, 15, 16, 17 are deflecting electrodes for deflecting electron beams, and Vdef is a voltage source for deflection.

In the construction of FIG. 4, the electron beam emitted from each electron-emitting device 1 can be deflected toward the boundary 11 between the substrates by applying an appropriate deflection voltage between the deflecting electrodes with such a polarity as that the boundary 11 between the substrates is subjected to a higher potential.

Accordingly, with no need of forming the electron-emitting devices in an area near the boundary 11 between the substrates, the fluorescent substances in that area can be irradiated by electron beams and hence the display incapable region can be prevented from appearing.

The second measure will now be described in more detail.

Assuming that the array pitch of pixels on the face plate 12 in the X-direction is Px, the array spacing of the electron-emitting devices on the substrate 10A is PAx, and the array spacing of the electron-emitting devices on the substrate 10B is PBx, values of these pitch and spacings are set to meet PAx=PBx=Px.

Unlike the above case of the first measure, the electron-emitting devices used herein may be of step (vertical) type that the positive electrode, the negative electrodes and the electron-emitting region are vertically laminated on the substrate plane. Therefore, the electron-emitting devices shown in FIGS. 32 and 33 may also be used.

The deflecting electrode 16 is positioned substantially above the substrate boundary 11, and three deflecting electrodes 15, 16, 17 are positioned to be spaced a distance Ldx from each other in the X-direction as shown. Each of the deflecting electrodes is mounted such that its lower end is substantially the same level as the surfaces of the electron-emitting devices 1 on the substrate and it has a height of Ldz.

In the above-described construction, the distance Ls between the adjacent electron-emitting devices on both sides of the substrate boundary 11 is approximately set to a value determined by the following equation [3];

$$Ls=Px+(2\cdot Vdef\cdot Lh\cdot Ldz)/(Va\cdot Ldx) \quad [3]$$

where

Px [m] is the array pitch of pixels in the X-direction,

Lh [m] is the distance between the electron-emitting device and the fluorescent substance, Ldx [m] is the distance between the deflecting electrodes, Ldz [m] is the height of the deflecting electrode, Va [V] is the voltage applied to the fluorescent substance, and Vdef [V] is the voltage applied to the deflecting electrode.

Note that it is desired to add a correction term to the equation [3] when the height Ldz of the deflecting electrode is much different from the distance Lh between the electron-emitting device and the fluorescent substance.

Depending on the electron-emitting devices used, initial velocity of the electron beams is relatively large. In such a case, it is desired to add a correction term to the equation [3] and determine a value of the correction term by experiments or simulation using a computer.

As will be seen from the equation [3], Ls can be made sufficiently large by setting the appropriate conditions. In other words, the display incapable region can be prevented from appearing with no need of forming the electron-emitting devices near the substrate ends.

The second measure for realizing the method of flying electron beams according to the present invention, shown in FIG. 1A, has been explained above.

Note that both the above-described first and second measures may be used in a combined manner.

Preferred Embodiments

Preferred embodiments for carrying out the present invention will be described hereinafter.

(Embodiments of Layout of Electron Source Substrates)

In practicing the present invention, there are no limits in the number and layout of used substrates each having electron-emitting devices formed thereon (referred to as electron source substrates in the following description). Generally speaking, however, it is desired that an image display apparatus has a rectangular screen, and hence a plurality of electron source substrates are arranged in such layouts as illustrated in FIGS. 5A to 5D.

FIGS. 5A to 5D are plan views each showing a layout of electron source substrates. In the drawings, denoted by E1 to E20 are independent electron source substrates. FIGS. 5A, 5B, 5C and 5D show layouts in which two, four, six and eight electron source substrates are arranged, respectively. One-dot-chain lines in the drawings each indicate the boundary between the electron source substrates.

Because image display apparatuses having horizontally elongated screens, such as high-definition TVs, are often required in recent years, the layouts shown in FIGS. 5A to 5D are designed correspondingly. Of course, the electron source substrates may be arranged into a vertically elongated layout or a square layout with vertical and horizontal lengths being equal to each other.

For easier assembly, the electron source substrates are each desired to be square or rectangular in shape. Also, the electron source substrates adjacent to each other are desired to have their sides of the same length along the boundary.

(Embodiments of Mounting Method of Electron Source Substrates)

A description will now be described of a method of mounting a plurality of electron source substrates to a structural member of an image display apparatus when carrying out the present invention.

The method of mounting a plurality of electron source substrates to a structural member of an image display apparatus is mainly divided depending on whether the electron source substrates serve as part of the hermetic structure of a vacuum container of the image display apparatus or not.

The former method in which the substrates serve as part of the hermetic structure is further divided depending on whether the boundary between the electron source substrates has in itself the hermetic structure or not. The latter method in which the substrates do not serve as part of the hermetic structure is further divided depending on whether the electron source substrates are contacted with each other or not at the boundary therebetween. These methods will be described below with reference to FIGS. 6A to 6D.

FIGS. 6A to 6D show, in section, image display apparatuses each having two electron source substrates. In these drawings, denoted by E1 and E2 are electron source substrates, 70 is a face plate, 71 is a side wall, 72 is a rear plate, and 73 is a boundary between the electron source substrates, the boundary being surrounded by a dotted line.

Figure 6A:
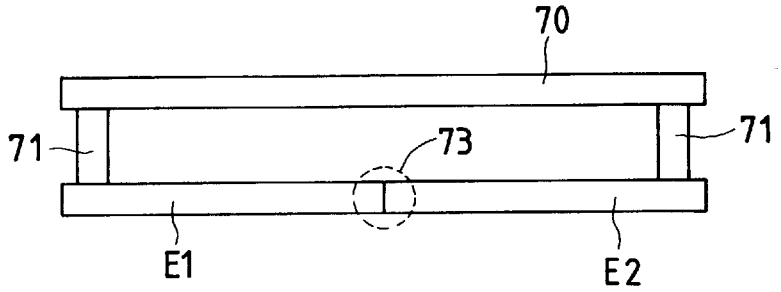
FIGS. 6A to 6D are sectional views each showing a mounting method of the electron source substrates in the present invention.
Figure 6B:
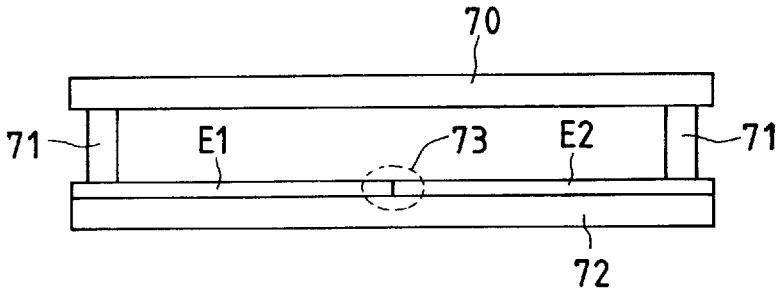
Figure 6C:
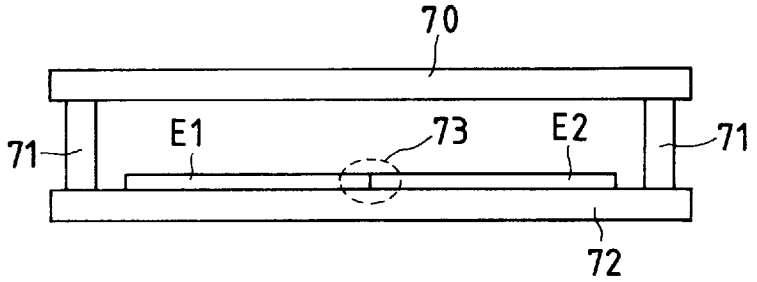
Figure 6D:
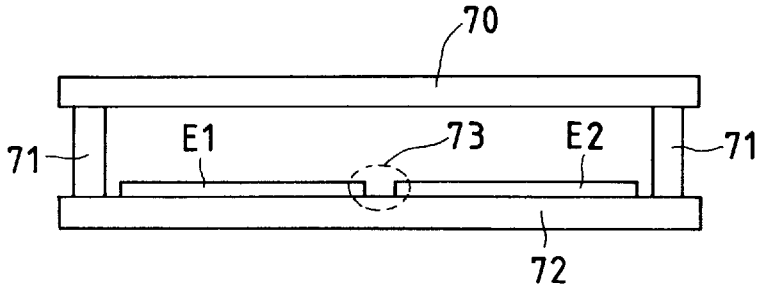

FIGS. 6A and 6B show embodiments in which the electron source substrates serve as part of the hermetic structure of a vacuum container, and FIGS. 6C and 6D show embodiments in which the electron source substrates do not serve as part of the hermetic structure.

First, according to the method illustrated in FIG. 6A, portions where the electron source substrates E1, E2, are joined to the side wall 71 and the boundary 73 between the electron source substrates E1 and E2 are formed into the hermetic structure. In this embodiment, since the electron source substrates E1, E2 are directly subjected to the atmospheric pressure, it is desired that the substrates be sufficiently thick to ensure the mechanical strength. This mounting method is suitable for, e.g., the case of using glass substrates as the electron source substrates. For ensuring a sufficient degree of airightness and mechanical strength, a glass having the low melting point is preferably used to join the substrates at the boundary 73.

Then, according to the method illustrated in FIG. 6B, portions where the electron source substrates E1, E2 are joined to the side wall 71 and portions where the electron source substrates E1, E2 are joined to the rear plate 72 are formed into the hermetic structure. In this embodiment, a contact portion or an interface between the electron source substrates E1 and E2 is not required to have the hermetic structure. Since the mechanical strength against the atmospheric pressure is primarily sustained by the rear plate 72, the electron source substrates are not particularly required to have a large thickness. Therefore, the weight of the electron source substrates themselves can be reduced. Consequently, as compared with the case of FIG. 6A, the substrates can be more easily held and carried during the steps of film-forming and patterning to form the electron-emitting devices and the wirings.

In the method illustrated in FIG. 6C, the electron source substrates E1, E2 do not serve as part of the hermetic structure of the vacuum container. Also, the mechanical strength against the atmospheric pressure is primarily sustained by the rear plate 72. Therefore, the electron source substrates E1, E2 may be thin in thickness and are not required to be firmly secured to the rear plate 72. Consequently, this mounting method is suitable for the case of using, e.g., silicon wafers as the electron source substrates.

The method illustrated in FIG. 6D is basically analogous to the method illustrated in FIG. 6C except that the electron source substrates are not contacted with each other at the boundary 73 therebetween. This mounting method is suitable for the case where the electron source substrates cannot be formed to have linear outer peripheral edges. Specifically, when the electron source substrates have irregularities or burrs in their outer peripheral edges as a result of cutting or grinding the substrates in the manufacture process, a predetermined degree of positional accuracy cannot be achieved even if the substrates are closely contacted with each other. Even to the case where such a situation is expected from the manufacture process, the present invention can also be suitably applied with the mounting method of FIG. 6D by setting the distance Ls between the electron-emitting devices (see FIGS. 1B and 4) to be sufficiently large beforehand.

(Embodiments of Wiring for Power Supply to Electron Source Substrates)

A description will now be described of preferred embodiments of a power supply method to a plurality of electron source substrates when carrying out the present invention.

Figure 34:
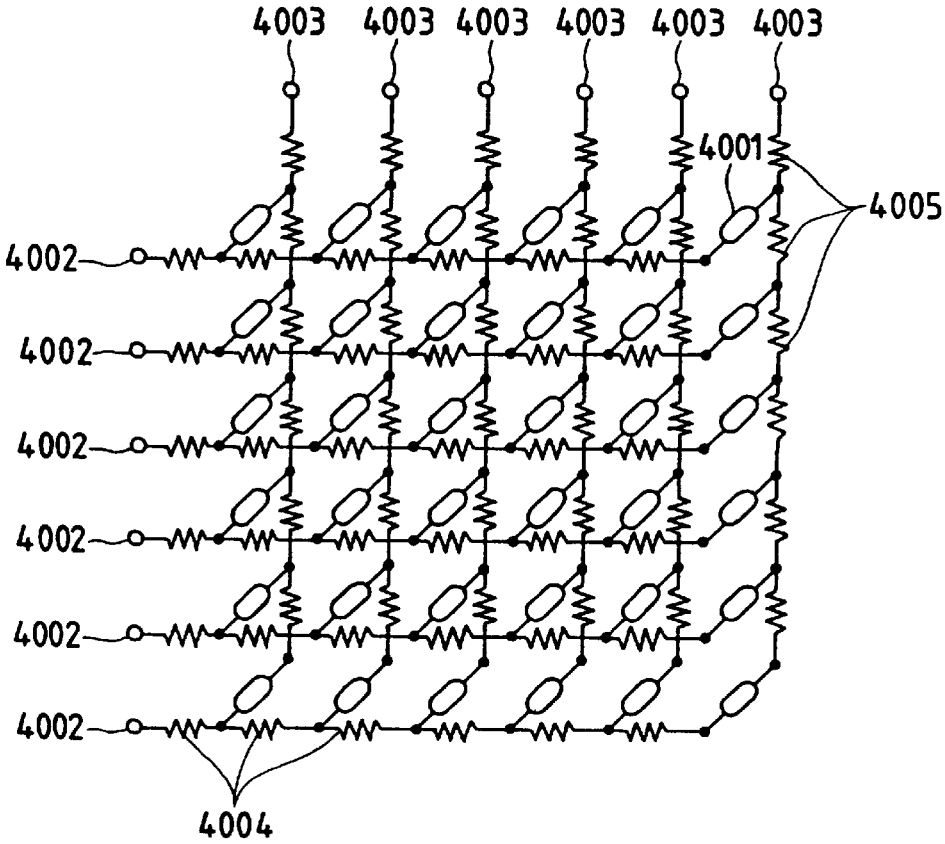
FIG. 34 PRIOR ART
FIG. 34 is a diagram showing a wiring method for electron-emitting devices.
Figure 35A:
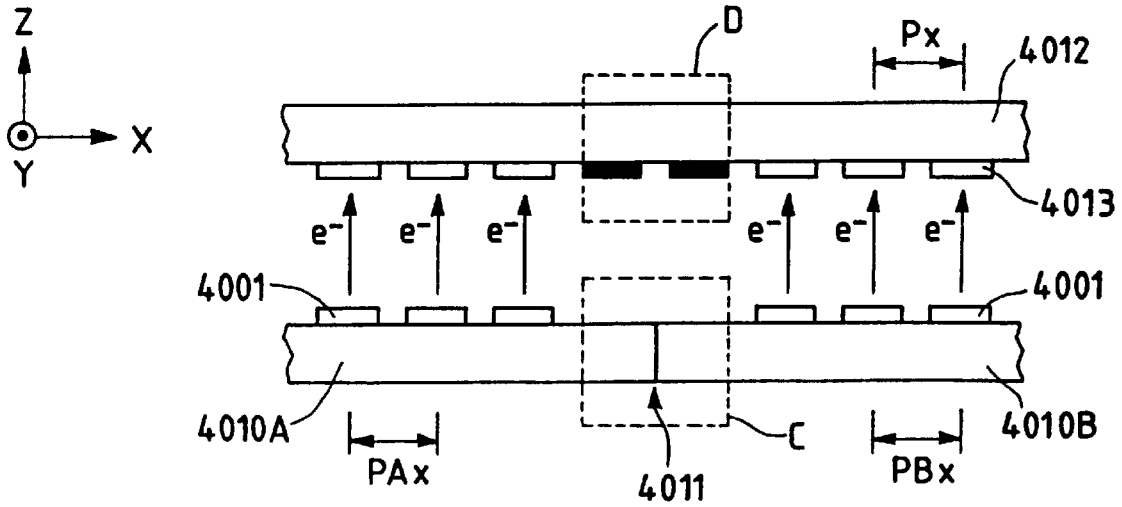
FIG. 35A PRIOR ART
FIGS. 35A and 35B are views each showing a display incapable region to be eliminated in the present invention.
Figure 35B:
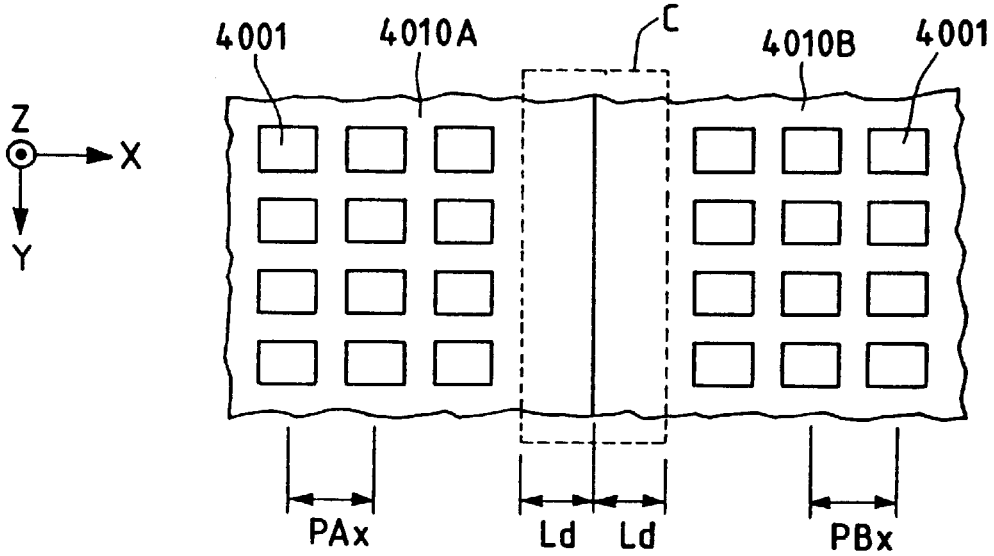
FIG. 35B PRIOR ART

FIGS. 7A to 7D are schematic views showing embodiments of the power supply method to the electron source substrates. In these drawings, denoted by E1 to E20 are electron source substrates and Dx, Dy are feed terminals for supplying drive signals to the electron source substrates from an electric circuit (not shown) therethrough. The electron source substrates each have a number of electron-emitting devices which are formed thereon and wired into the matrix pattern, for example, as shown in FIG. 34.

Figure 7A:
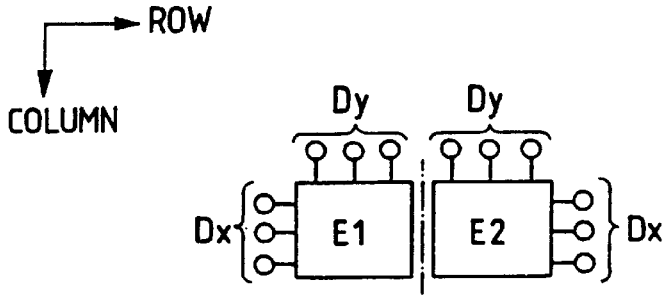
FIGS. 7A to 7D are views each showing a wiring arrangement for power supply to the electron source substrates in the present invention.

FIG. 7A shows the most basic embodiment in which the drive signals are supplied through the feed terminals provided corresponding to the electron-emitting devices for each of electron source substrates. This embodiment is suitable for the case of using two or four electron source substrates because of an advantage that the electron source substrates are not electrically connected to each other and hence the boundary between the substrates is simple in structure.

Figure 7B:
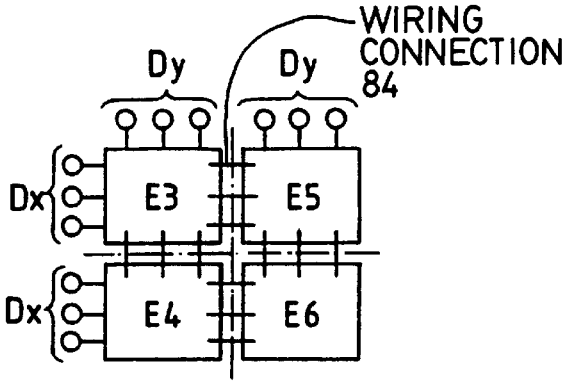

FIG. 7B shows an embodiment in which wirings on the electron source substrates are electrically connected to each other such that row-directional wirings are interconnected between E3 and E5 and between E4 and E6, and column-directional wirings are interconnected between E3 and E4 and between E5 and E6. This embodiment is advantageous in reducing the number of the feed terminals Dx, Dy and drive circuits to a half.

Figure 8:
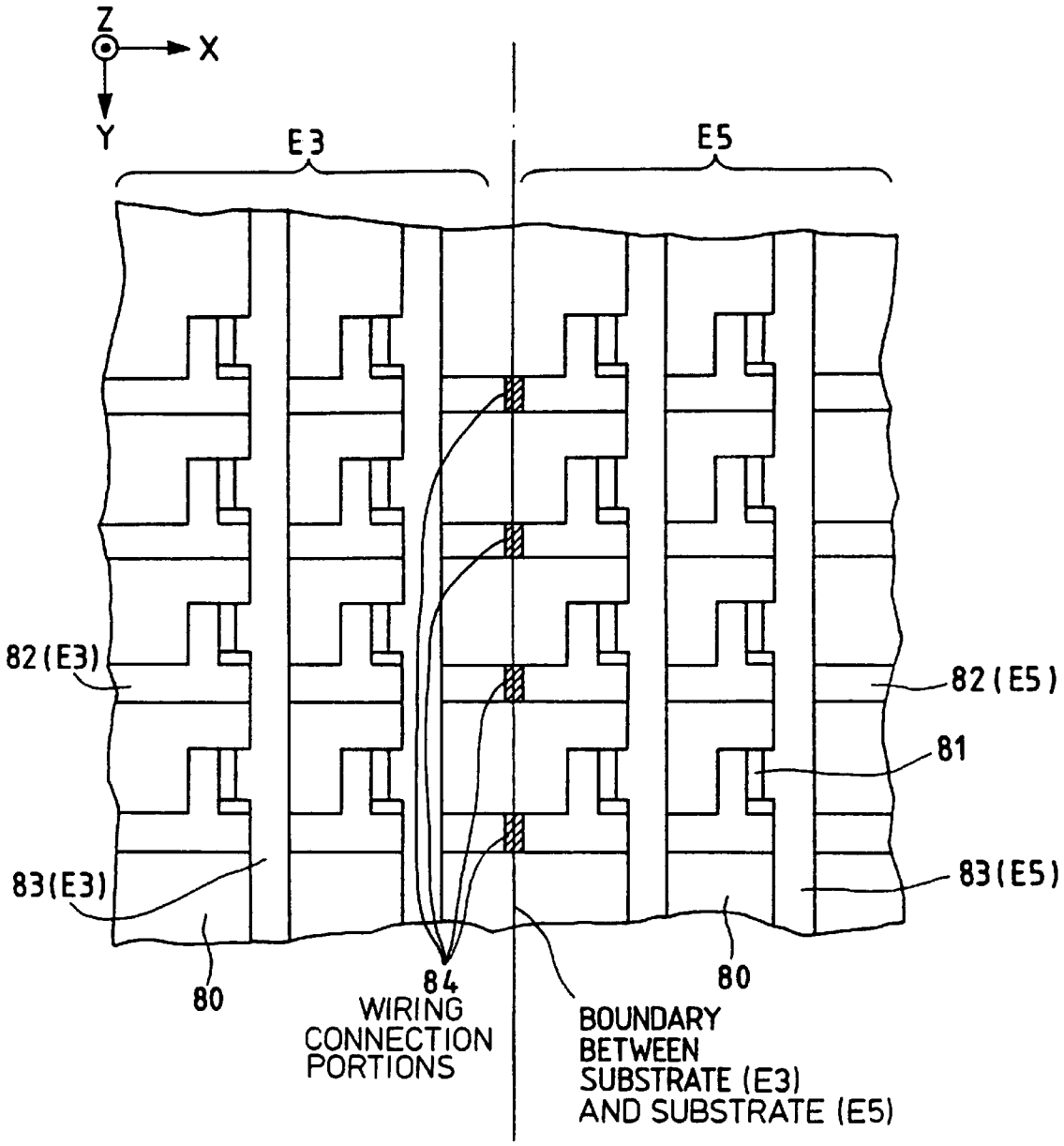
FIG. 8 is a plan view showing the method of FIG. 7B in detail.

FIG. 8 is a plan view for explaining the method of FIG. 7B in more detail, the view showing the manner in which row-directional wirings on the electron source substrates E3 and E5 are electrically interconnected at the boundary therebetween. In FIG. 8, denoted by 80 is a substrate of the electron source substrate E3 or E5, 81 is an electron-emitting device, 82(E3) is a row-directional wiring on the electron source substrate E3, 82(E5) is a row-directional wiring on the electron source substrate E5, 83(E3) is a column-directional wiring on the electron source substrate E3, 83(E5) is a column-directional wiring on the electron source substrate E5, and 84 is a wiring connecting portion. As a manufacture method of the electron source substrate will be described later in detail with reference to Example, the wiring connecting portion 84 is described here. The wiring connecting portion 84 can be formed by, e.g., coating a proper amount of metal frit or cream solder, as connecting materials, by screen printing or a dispenser, and then heating it. Alternatively, it is also possible to plate solder at the wiring ends beforehand, and then melt the solder again by heating for interconnection after positioning the substrates in a closely contact state. In addition, the wiring ends may be interconnected by plating the substrates in a closely contact state, or they may be electrically conducted to each other by any other suitable bonding method.

Figure 7C:
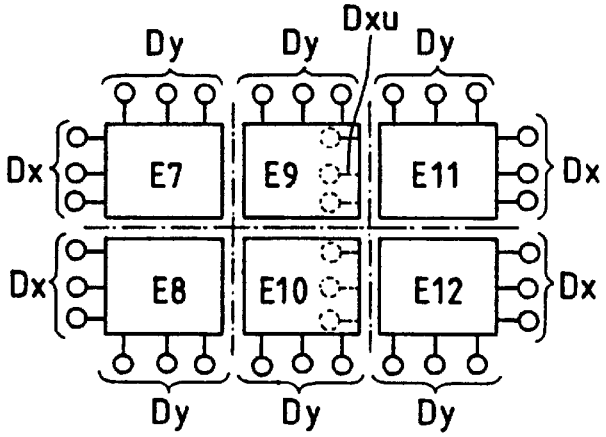

FIG. 7C shows an embodiment in which the method of FIG. 7A is modified. For the wirings which can be easily extended out from outer periphery edges of the electron source substrates, the feed terminals Dx, Dy are employed in the same manner as in FIG. 7A. But, for the wirings which have difficulties in directly extending them out parallel to the substrate plane, like the row-directional wirings on E9 and E10, the wirings are extended to the rear side of the substrate while covering one side face. (In FIG. 7C, feed terminals Dxu of those wirings are schematically shown by dotted lines.)

Figure 9A:
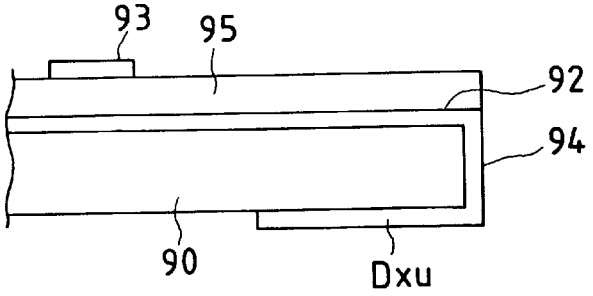
FIGS. 9A and 9B are sectional views each showing the method of FIG. 7C in detail.

A substrate end portion including the feed terminals Dxu will now be described in more detail with reference to FIGS. 9A and 9B. FIG. 9A is a sectional view showing one embodiment in which the row-directional wirings on the electron source substrate E9 are extended to the rear side of the substrate while covering one side face. In FIG. 9A, denoted by 90 is a substrate, 92 is a row-directional wiring, 93 is a column-directional wiring, 94 is a side face covering conductive member or layer, 95 is an insulating layer between the row-directional wiring and the column-directional wiring, and Dxu is a feed terminal.

Figure 10:
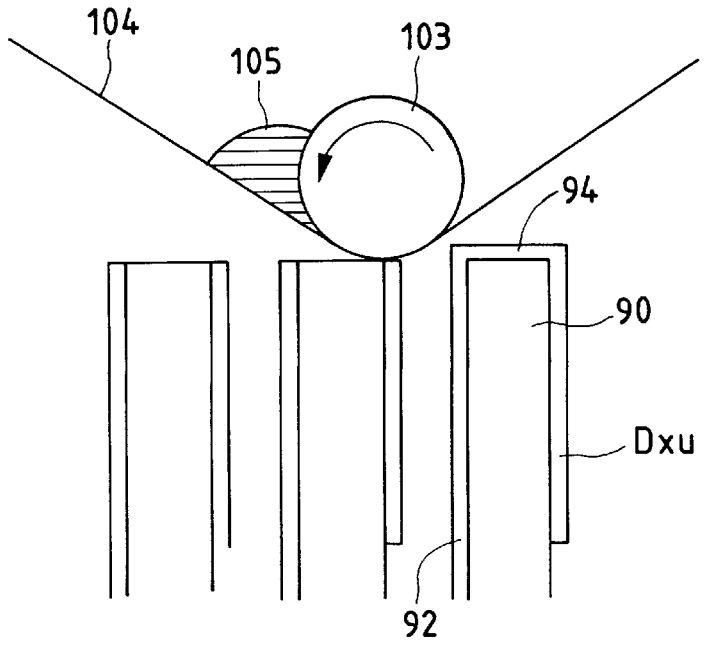
FIG. 10 is a view showing a method of manufacturing an electron source substrate E9 in FIG. 9B.

The side face covering conductive layer 94 can be suitably formed over one side face of the substrate 90 by a coating method shown in FIG. 10, for example. Specifically, FIG. 10 shows a method of forming the side face covering conductive layer 94 by printing. Denoted by 103 is a roller, 104 is a screen comprising a metal mesh, and 105 is a conductive paste containing, e.g., nickel, copper, silver and so on as main ingredients. The substrate 90 having the row-directional wiring 92 and the feed terminal Dxu formed thereon beforehand is set in a printing machine such that the relevant side face of the substrate faces a printing screen. The roller 103 is then rotated while applying a proper force thereto. As a result, the side face covering conductive layer 94 can be formed over the side face of the substrate 90.

Figure 9B:
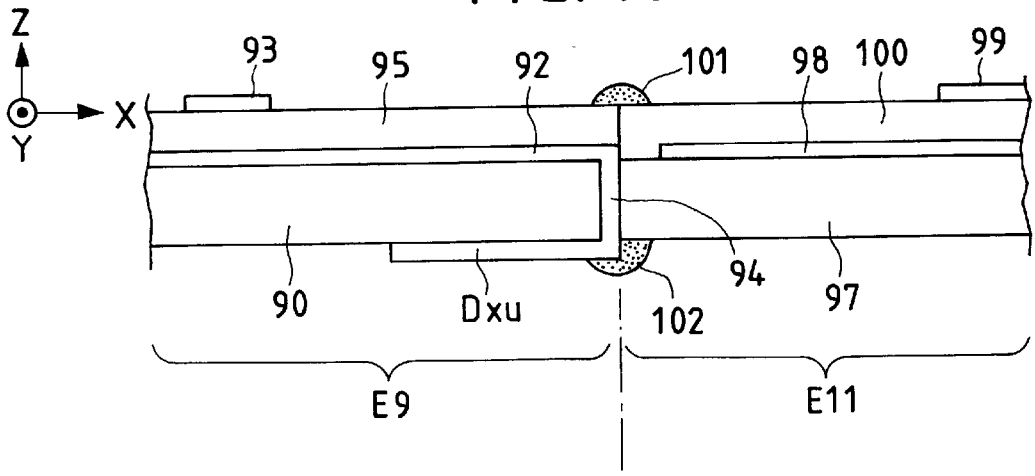

FIG. 9B is a sectional view showing a portion in FIG. 9A where the electron source substrate E9 and the electron source substrate E11 are joined to each other. In FIG. 9B, reference numerals 97 to 100 denote constituent members of the electron source substrate E11. Specifically, 97 is a substrate of the electron source substrate E11, 98 is a row-directional wiring, 99 is a column-directional wiring, and 100 is an insulating layer. 101 and 102 are adhesives for bonding the electron source substrates E9 and E11 together. As shown, the row-directional wiring 92 on the electron source substrate E9 is electrically connected through the side face covering conductive layer 94 to the feed terminal Dxu on the rear side of the substrate. To ensure a sufficient degree of mechanical strength and air thickness, a glass having the low melting point is used as the adhesives 101 and 102.

Figure 7D:
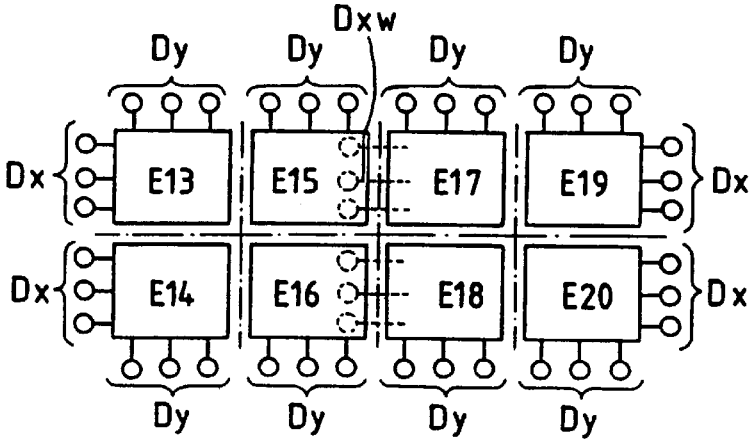

FIG. 7D shows an embodiment in which the method of FIG. 7C is modified. This embodiment is suitable for the case of using eight or more electron source substrates. As shown, the row-directional wirings on the electron source substrates E15 and E17 are electrically interconnected at the boundary therebetween, and are also electrically connected via opposite side faces of the substrates to feed terminals Dxw formed on the rear side of the substrate E15. (In FIG. 7D, the feed terminals Dxw are schematically shown by dotted lines.) Further, the row-directional wirings on the electron source substrates E16 and E18 are electrically interconnected in a similar manner.

Figure 11:
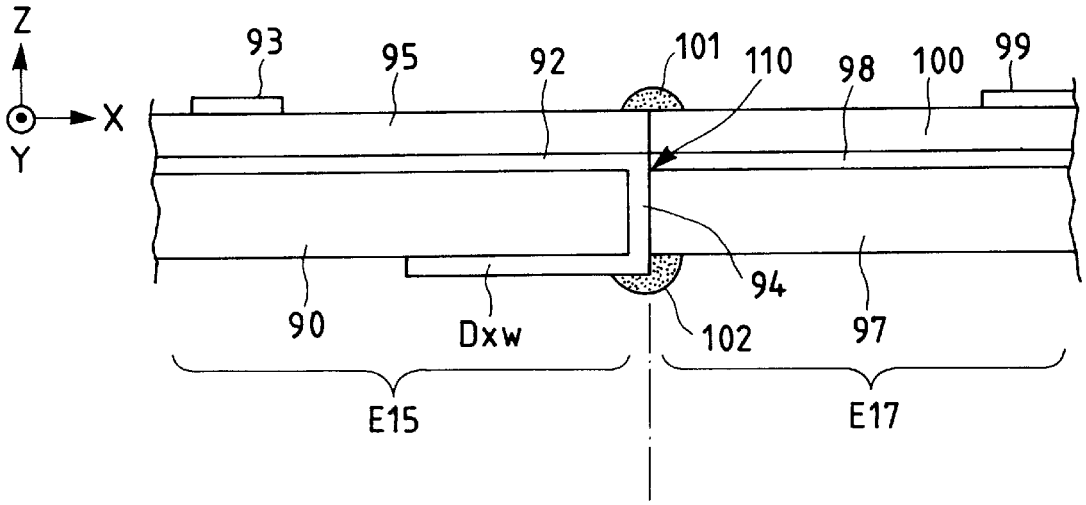
FIG. 11 is a sectional view showing the method of FIG. 7D in detail.

FIG. 11 is a sectional view showing the structure of a joined portion between the electron source substrates E15 and E17. As shown, the joining structure is basically analogous to that shown in FIG. 9B. (In FIG. 11, members common to those in FIG. 9B are denoted by the same reference numerals.) In the structure of FIG. 11, the row-directional wirings 92 and 98 are electrically connected to each other in a contact portion 110 therebetween. It is thus possible to supply the drive signals from the feed terminals Dxw to the row-directional wirings on both the electron source substrates. In the contact portion 110, the electrical connection between the row-directional wirings is basically established through mechanical contact. To provide more satisfactory and positive electrical connection, the row-directional wirings may be interconnected by, e.g., placing a highly plastic metallic member in the contact portion and pressing the substrates against each other, or placing a metallic member with the low melting point and melting it to fuse the substrates together.

In connection with the case of using a plurality of electron source substrates, the power supply methods to the electron source substrates have been described above. By using any one of the above-described methods solely or any two or mores in a combined manner, electric power can be suitably supplied in the case of employing two or more electron source substrates.

Next, the first measure of the present invention explained above in connection with FIG. 1B will be described in more detail with reference to FIGS. 12 to 16B.

Figure 12:
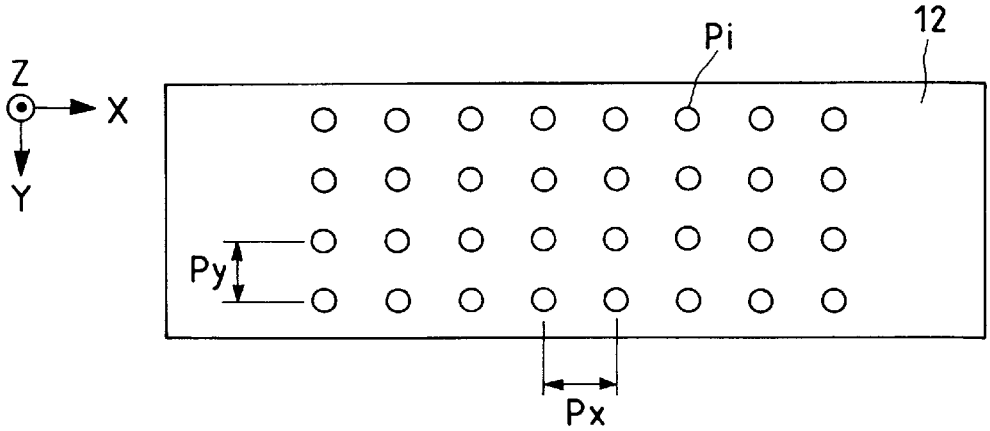
FIG. 12 is a plan view showing an arrangement of pixels in a display panel.

FIG. 12 is a plan view showing one exemplary array of pixels on a face plate of an image display apparatus. In FIG. 12, denoted by 12 is a substrate of the face plate and Pi is a pixel. As shown, a number of pixels Pi are arrayed in a display screen with a pitch Px in the X-direction and a pitch Py in the Y-direction.

Embodiments of the first measure of the present invention using electron source substrates in combination with the pixel array of FIG. 12 will be described with reference to FIGS. 13A to 13D. The embodiments shown in FIGS. 13A to 13D correspond respectively to the layouts of electron source substrates shown in FIGS. 5A to 5D.

FIGS. 13A to 13D are schematic plan views for explaining the layouts of a plurality of electron source substrates and the manners in which electron-emitting devices are arrayed in each of the electron source substrates. In the drawings, the boundary between the electron source substrates is indicated by a one-dot-chain line. Also, the marks explained above in connection with FIGS. 3A and 3B (i.e., the rectangular boxes with arrows put therein) are employed to clearly show the direction in which electron-emitting devices are arrayed in each electron source substrate. Further, to distinguish the direction R of devices arrayed on each electron source substrate, the direction of devices on an electron source substrate E1, for example, is expressed by R(E1).

Figure 13A:
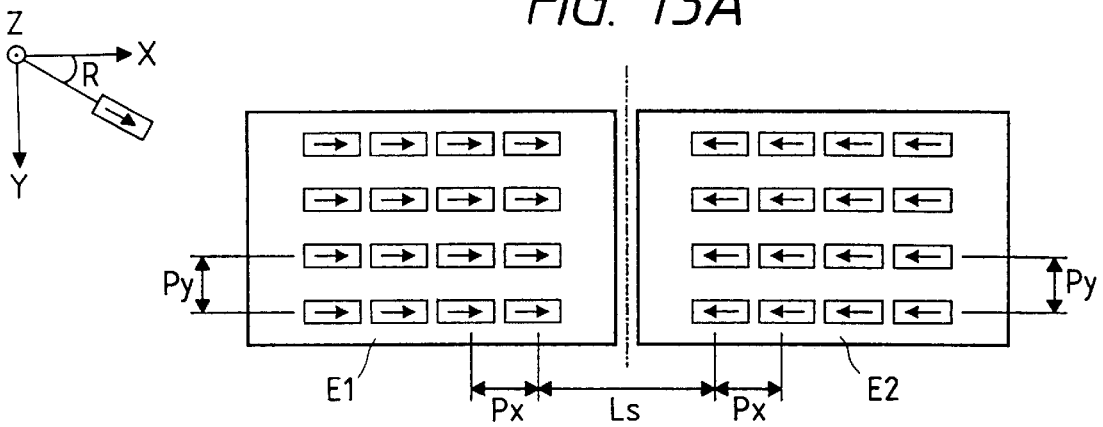
FIGS. 13A to 13D are plan views showing different forms of the first measure of the present invention.

FIG. 13A shows an embodiment using two electron source substrates E1 and E2 on which the directions of the electron-emitting devices are set respectively to R(E1)=0 degree and R(E2)=180 degrees, and the array pitches of the electron-emitting devices are set respectively to be equal to the pixel array pitches Px, Py. The spacing Ls between the electron-emitting devices on both sides of the substrate boundary are set to a value meeting the equations [1] and [2], as described above.

Figure 13B:
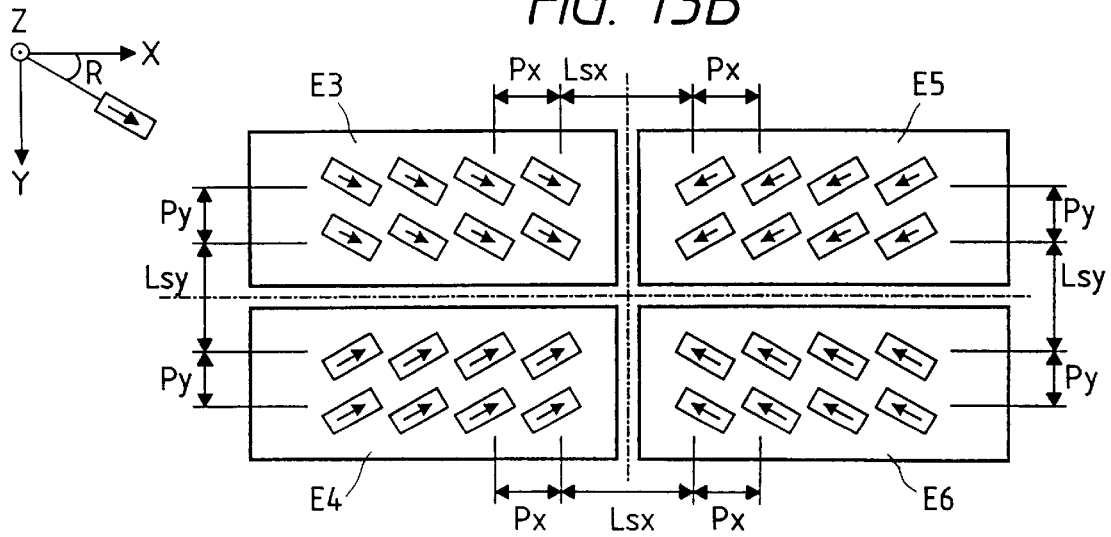

FIG. 13B shows an embodiment using four electron source substrates E3 to E6 on each of which the array pitches of the electron-emitting devices are set respectively to be equal to the pixel array pitches Px, Py. Also, the direction of the electron-emitting devices on each of the electron source substrates is set to fall within corresponding one of the angle ranges defined as follows:

$0° < R(E3) < 90°$ $90° < R(E5) < 180°$ $180° < R(E6) < 270°$ $270° < R(E4) < 360°$

In the following description, the angle will be represented in units of degree unless otherwise noted specifically.

The directions of the electron-emitting devices further meet the following relative equations. This means that the directions of the electron-emitting devices are set to be line-symmetrical with respect to each substrate boundary.

R(E4)=360°−R(E3)

R(E5)=180°−R(E3)

R(E6)=180°+R(E3)

Additionally, spacings Lsx and Lsy between the adjacent electron-emitting devices on both sides of the respective substrate boundaries are set to meet the following relative equations;

$$Lsx=Px+2\cdot Lef\cdot \mathrm{COS}\,[R(E3)]$$

$$Lsy=Py+2\cdot Lef\cdot \mathrm{SIN}\,[R(E3)]$$

where Lef is the value determined from the equation [1].

Figure 13C:
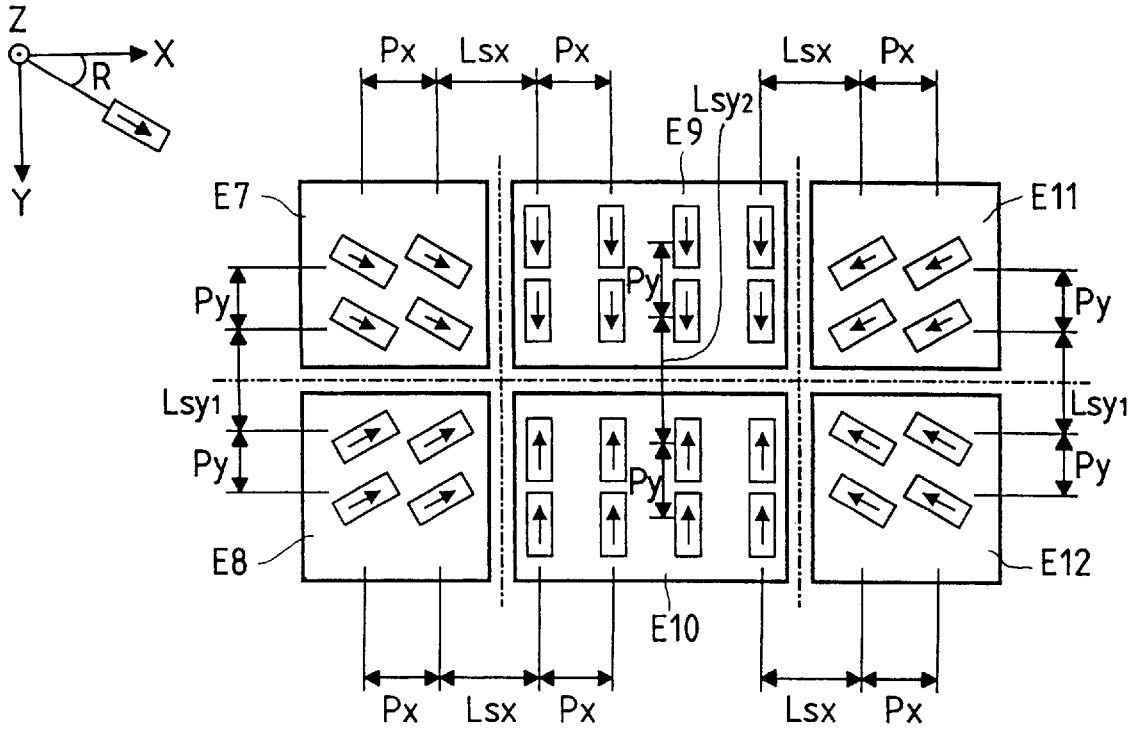

FIG. 13C shows an embodiment using six electron source substrates E7 to E12 on each of which the array pitches of the electron-emitting devices are set respectively to be equal to the pixel array pitches Px, Py. Also, the direction of the electron-emitting devices on each of the electron source substrates is set to fall within corresponding one of the angle ranges defined as follows:

0°<R(E7)<90°

90°<R(E11)<180°

180°<R(E12)<270°

270°<R(E8)<360°

R(E9)=90°

R(E10)=270°

R(E8)=360°−R(E7)

R(E11)=180°−R(E7)

R(E12)=180°+R(E7)

Further, spacings Lsx, Lys1 and Lsy2 between the adjacent electron-emitting devices on both sides of the respective substrate boundaries are set to meet the following relative equations;

$$Lsx=Px+Lef\cdot \mathrm{COS}\,[R(E7)]$$

$$Lsy1=Py+2\cdot Lef\cdot \mathrm{SIN}\,[R(E7)]$$

$$Lsy2=Py+2\cdot Lef$$

where Lef is the value determined from the equation [1].

Figure 13D:
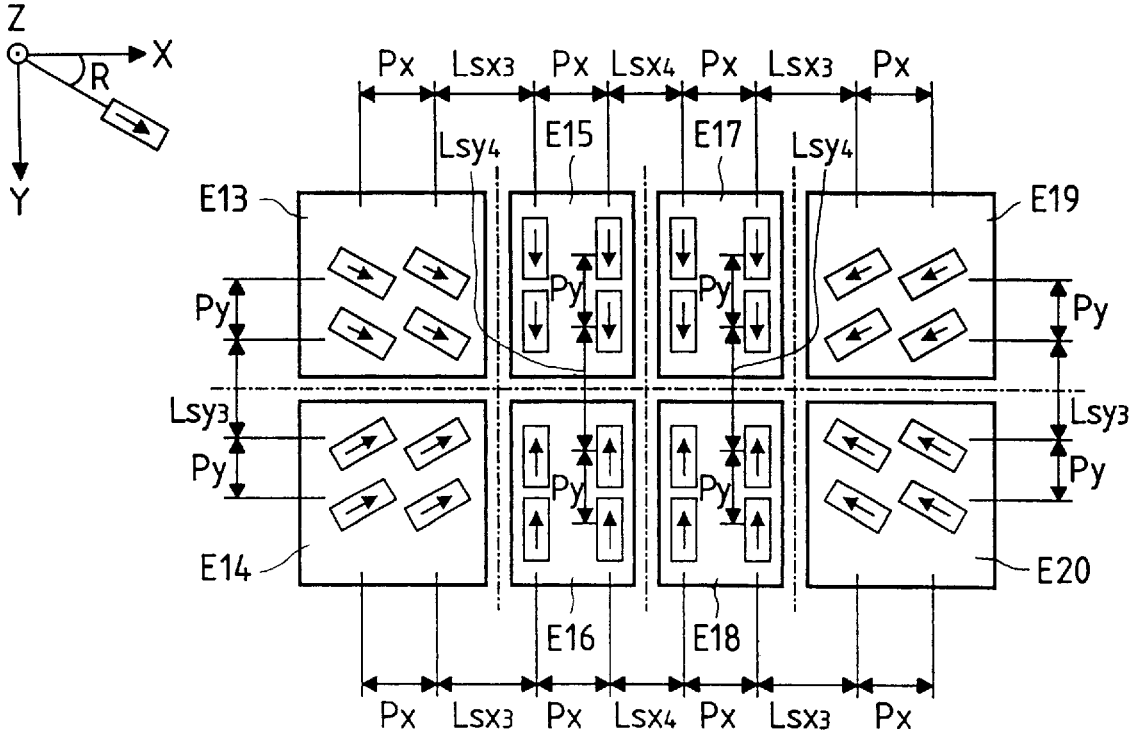

FIG. 13D shows an embodiment using eight electron source substrates E13 to E20 on each of which the array pitches of the electron-emitting devices are set respectively to be equal to the pixel array pitches Px, Py. Also, the direction of the electron-emitting devices on each of the electron source substrates is set to fall within corresponding one of the angle ranges defined as follows:

0°<R(E13)<R(E15)<90°

90°<R(E17)<R(E19)<180°

180°<R(E20)<R(E18)<270°

270°<R(E16)<R(E14)<360°

R(E14)=360°−R(E13)

R(E19)=180°−R(E13)

R(E20)=180°+R(E13)

R(E16)=360°−R(E15)

R(E17)=180°−R(E15)

R(E18)=180°+R(E15)

Further, spacings Lsx3, Lsx4, Lsy3, Lsy4 between the adjacent electron-emitting devices on both sides of the respective substrate boundaries are set to meet the following relative equations;

$$Lsx3=Px+Lef\cdot\{\mathrm{COS}\,[R(E13)]-\mathrm{COS}\,[R(E15)]\}$$

$$Lsx4=Px+2\cdot Lef\cdot \mathrm{COS}\,[R(E15)]$$

$$Lsy3=Py+2\cdot Lef\cdot \mathrm{SIN}\,[R(E13)]$$

$$Lsy4=Py+2\cdot Lef\cdot \mathrm{SIN}\,[R(E15)]$$

where Lef is the value determined from the equation [1].

The embodiments of the first measure of the present invention using the electron source substrates in different numbers have been described above with reference to FIGS. 13A to 13D. Thus, the array pitches of the electron-emitting devices on each electron source substrate are set to be equal to the respective pixel array pitches. Also, the direction of the electron-emitting devices is properly set for each of the electron source substrates. With such an arrangement, the electron beam can be emitted to fly while deviating a predetermined distance toward the substrate boundary, and the display incapable region can be prevented from appearing even if the distance between the adjacent electron-emitting devices on both sides of the substrate boundary is increased.

Next, preferred embodiments of the electron-emitting device for use with the first measure of the present invention will be described.

The electron-emitting device for use with the first measure of the present invention includes, as constituent members, a positive electrode, a negative electrode and an electron-emitting region, these members being formed side by side on the substrate plane. (Note that part of the negative electrode of the device may double as the electron-emitting region.)

The electron-emitting device meeting such requirements includes, e.g., a surface conduction electron-emitting device and a lateral field-emission electron-emitting device. These electron-emitting devices will be described below in this order.

The surface conduction electron-emitting device is of, e.g., the type shown in FIG. 31 or the type including fine particles near an electron-emitting region. As to the former type, there are already known electron-emitting devices using a variety of materials, as described before, all of these devices being suitable for use with the first measure of the present invention. As to the latter type, while materials, structures and manufacture processes of electron-emitting devices will be described later in connection with Example, all kinds of devices are suitable for use with the first measure. In other words, when using surface conduction electron-emitting devices to carry out the first measure, there are no particular limits in materials, structures and manufacture processes of the devices.

Figure 14A:
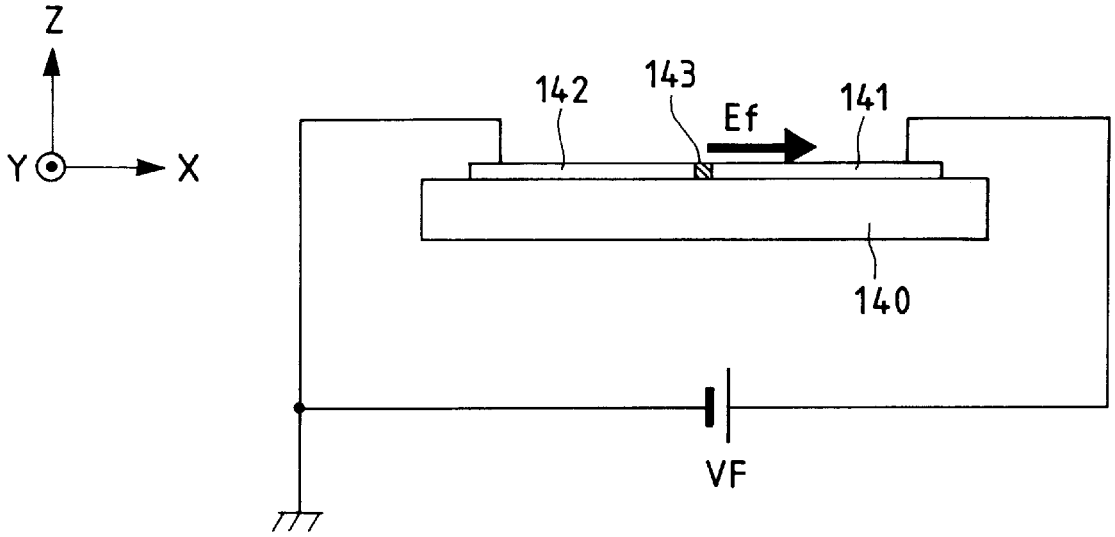
FIGS. 14A and 14B are views each showing the direction of a surface condition electron-emitting device.
Figure 14B:
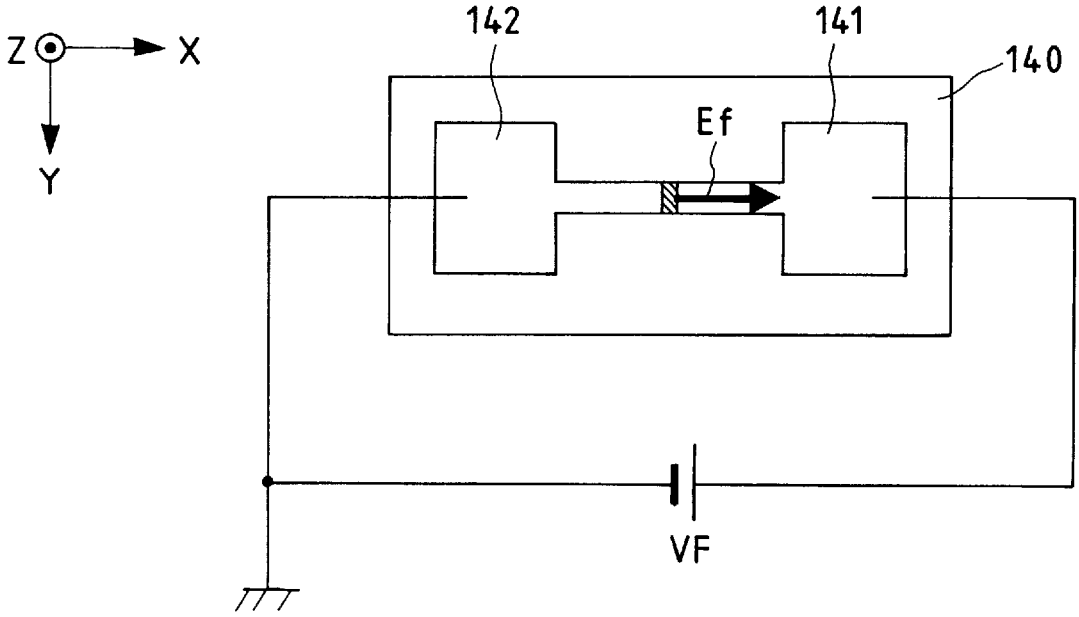

For the surface conduction electron-emitting device, a vector Ef indicating the direction in which an electron beam is deviated is expressed as shown in FIGS. 14A and 14B which are a sectional and plan view, respectively. In these drawings, denoted by 140 is a substrate, 141 is a positive electrode, 142 is a negative electrode, 143 is an electron-emitting region, and VF is a power supply for applying a drive voltage to the device.

Figure 15A:
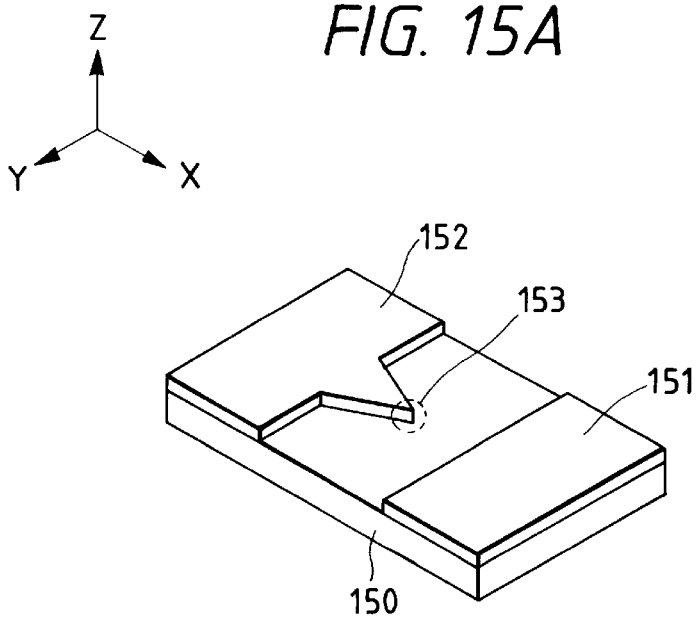
FIGS. 15A to 15C are perspective views each showing a lateral field-emission (FE) electron-emitting device suitable for the first measure.
Figure 15B:
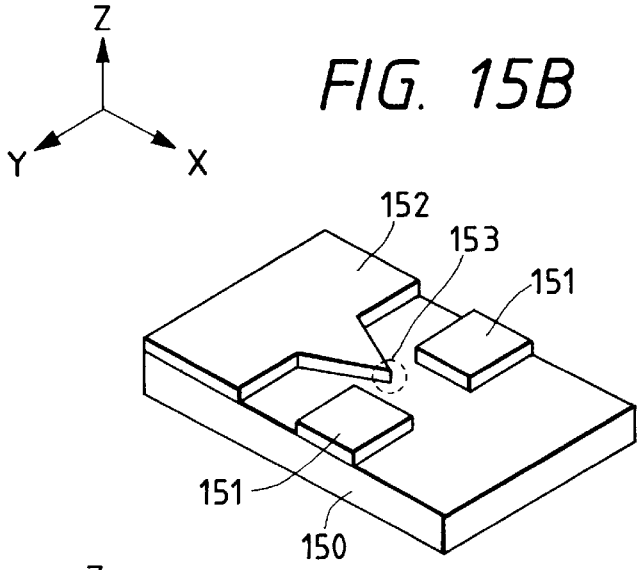
Figure 15C:
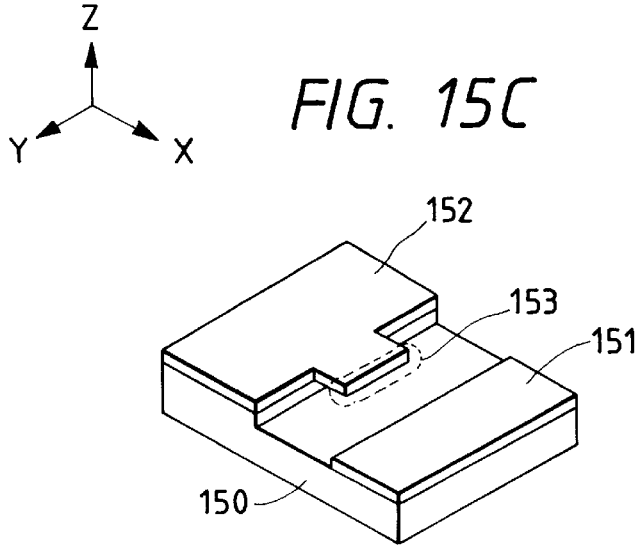

The lateral field-emission electron-emitting device means, particularly, the type of field-emission electron-emitting device in which a negative electrode, an electron-emitting region and a positive electrode are disposed side by side on the substrate plane. The above-mentioned device shown in FIG. 32, for example, does not belong to the lateral type because it has a negative electrode, an electron-emitting region and a positive electrode vertically disposed with respect to the substrate plane. On the other hand, electron-emitting devices illustrated in FIGS. 15A to 15C belong to the lateral type. FIGS. 15A to 15C are perspective views showing typical embodiments of the lateral field-emission electron-emitting device which is formed on the substrate plane in the X-direction. In these drawings, denoted by 150 is a substrate, 151 is a positive electrode, 152 is a negative electrode, and 153 is an electron-emitting region may have other various configurations than illustrated in FIGS. 15A to 15C. Thus, so long as the path of an electron beam is deviated from the vertical direction as described above with reference to FIGS. 2A and 2B, any kinds of lateral field-emission electron-emitting devices are suitable for use with the first measure of the present invention. For example, therefore, the electron-emitting devices of FIGS. 15A to 15C may be modified to additionally have a modulation electrode for modulating the intensity of an electron beam. Also, the electron-emitting region 153 may be formed by part of the negative electrode 152, or may be formed of a member disposed above the negative electrode. Materials used for the electron-emitting region of the lateral field-emission electron-emitting device includes, e.g., metals having the high melting points and diamond. However, any other materials which are capable of satisfactorily emitting electrons can also be employed.

Figure 16A:
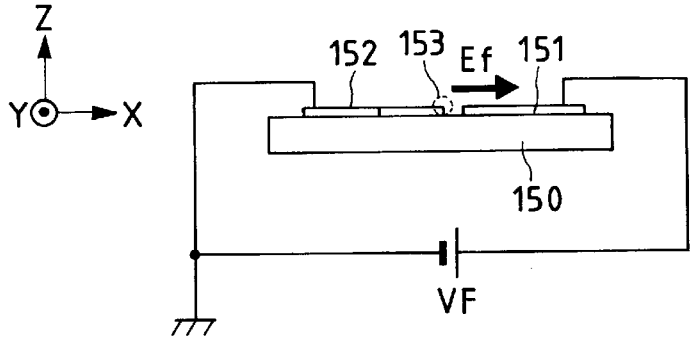
FIGS. 16A and 16B are views each showing the direction of the lateral FE electron-emitting device.
Figure 16B:
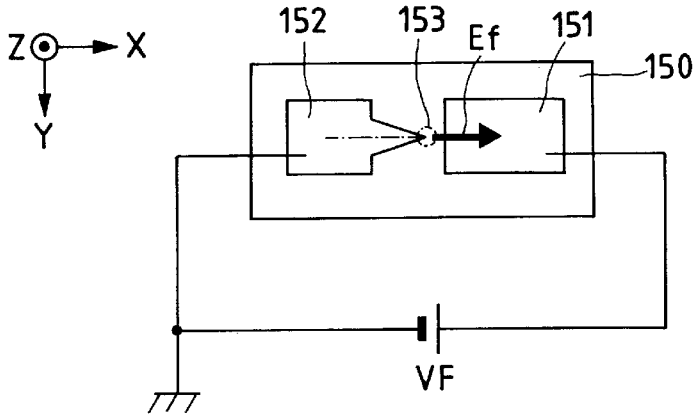

For the lateral field-emission electron-emitting device, a vector Ef indicating the direction in which an electron beam is deviated is expressed as shown in FIGS. 16A and 16B which are a sectional and plan view, respectively. In these drawings, denoted by 150 is a substrate, 151 is a positive electrode, 152 is a negative electrode, 153 is an electron-emitting region, and VF is a power supply for applying a drive voltage to the device.

Hereinabove, the first measure of the present invention has been described in detail.

Next, the second measure of the present invention explained above in connection with FIG. 4 will be described in more detail.

The second measure is featured in the provision of deflecting electrodes for deflecting electron beams toward the boundary between electron source substrates. The arrangement of the deflecting electrodes is not limited to the embodiment of FIG. 4.

Figure 17:
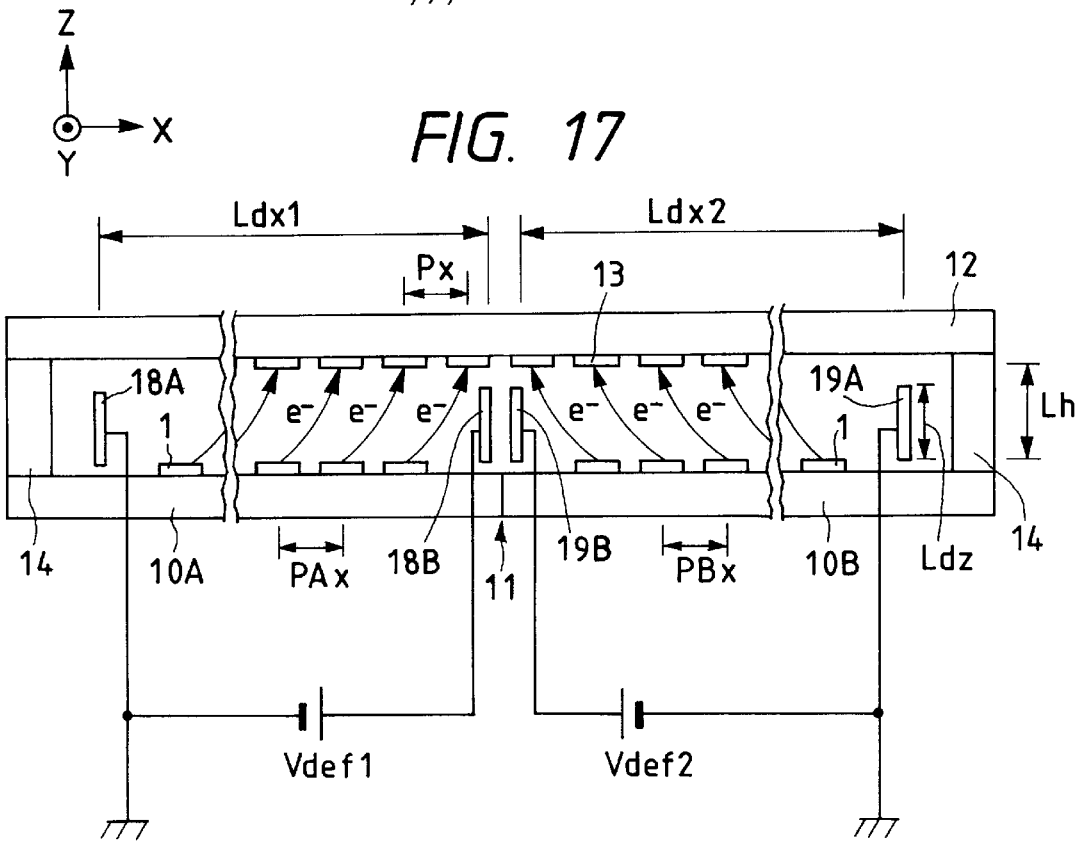
FIG. 17 is a sectional view showing a second measure of the present invention.

As shown in a sectional view of FIG. 17, for example, a pair of deflecting electrodes may be independently provided for each of electron source substrates. In FIG. 17, denoted by 1 is an electron-emitting device, 10A and 10B are electron source substrates, 11 is a boundary between the substrates, 14 is a side wall of an image display apparatus, 12 is a face plate, 13 is a fluorescent substance, 18A and 18B are deflecting electrodes for the electron source substrate 10A, and 19A and 19B are deflecting electrodes for the electron source substrate 10B. Also, voltage sources Vdef1 and Vdef2 are separately connected to the two pairs of deflecting electrodes. In the embodiment of FIG. 17, electron beams are deflected with the same basic principle as in the case of FIG. 4. But since voltages can be independently applied to the two pairs of deflecting electrodes, deflection of the electron beams can be controlled in an independent manner for each of the electron source substrates. Accordingly, even if the structure of a display apparatus is built up asymmetrically with respect to the substrate boundary 11 due to assembly errors, an image can be normally displayed by properly adjusting output voltages of Vdef1 and Vdef2.

Next, embodiments of the electron-emitting device for use with the second measure of the present invention will be described.

Unlike the above case of the first measure, the electron-emitting device used for carrying out the second measure of the present invention is not necessarily required to have a positive electrode, an electron-emitting region, and a negative electrode which are formed side by side on the substrate plane. For example, therefore, the field-emission electron-emitting device shown in FIG. 32 and the MIM device shown in FIG. 33 can also be used, not to mention of the surface conduction electron-emitting device and the lateral field-emission electron-emitting device which are used with the first measure. Additionally, a semiconductor electron-emitting device having a PN junction, for example, may also be used. In short, any types of electron-emitting devices are usable to carry out the second measure so long as they can emit an electron beam with the intensity enough to surely excite a fluorescent substance of the image display apparatus and can be formed on the substrate with a high density.

EXAMPLE 1

An example embodying the first measure of the present invention will be described below.

Figure 18:
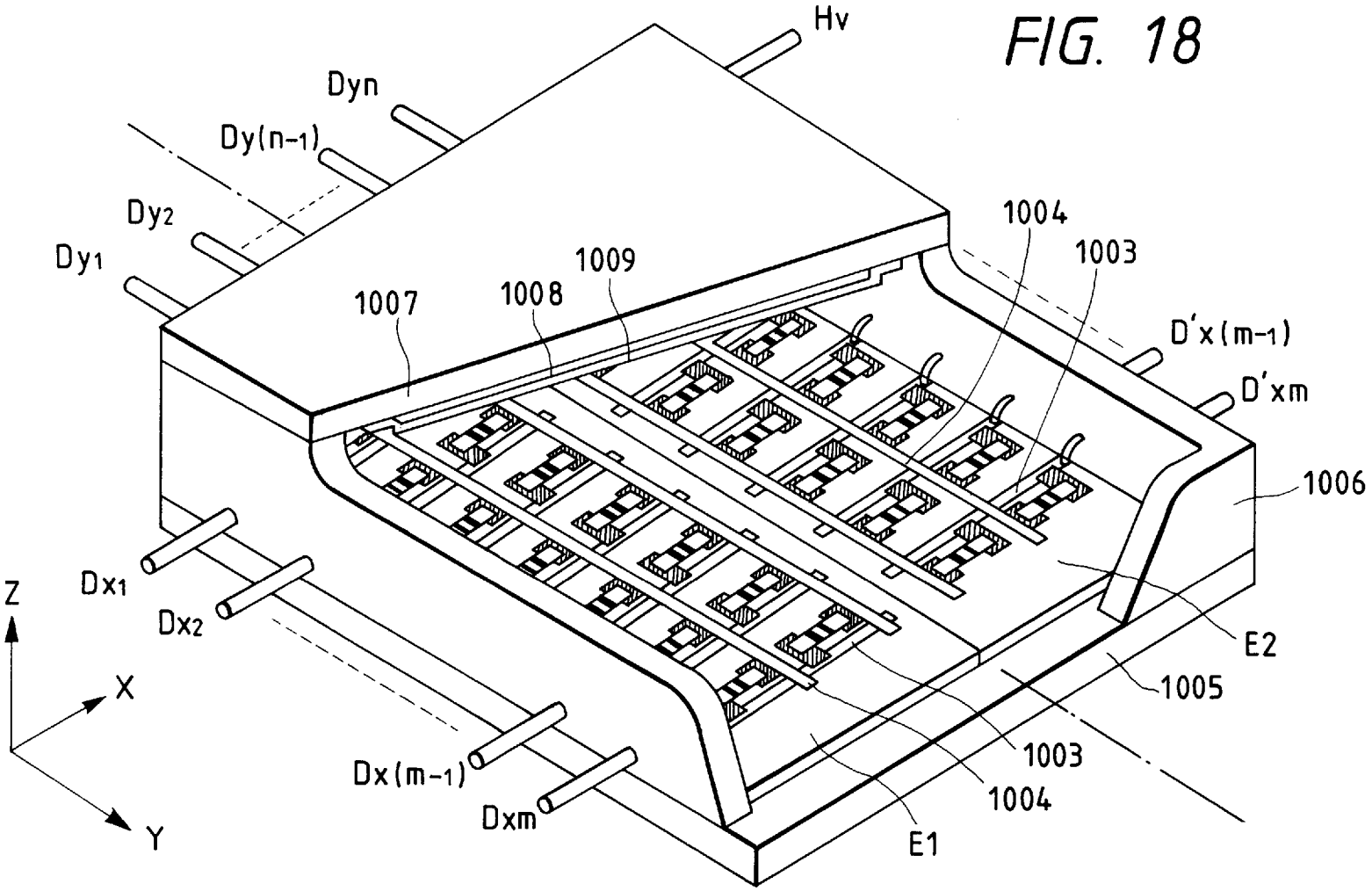
FIG. 18 is a perspective view, partly broken away, of a display panel of an image display apparatus according to an embodiment of the present invention.

FIG. 18 is a perspective view of a display panel using two electron source substrates, the panel being partly broken away to show the internal structure. This display panel employs the embodiment of FIG. 5A for the layout of the electron source substrates, the embodiment of FIG. 6C for the mounting method of the electron source substrates, the embodiment of FIG. 7A for the power supply method to the electron source substrates, and the embodiment of FIG. 13A for the arrangement of electron-emitting devices.

For this display panel, a description will be made below of the array of pixels, the arrangement of electron-emitting devices, the structure and manufacture process of the display panel, the construction, manufacture process and characteristics of the electron-emitting device, the structure of the electron source substrates, and the driving method of the display panel in sequence.

Array of Pixels

In this display panel, pixels were arrayed with the following pitches. Referring to the plan view of FIG. 12, pitch values were:

Px=0.5 mm

Py=0.5 mm

Arrangement of Electron-Emitting Devices

In this display panel, the electron-emitting devices were arranged as follows. Referring to the plan view of FIG. 13A, parameter values were:

Px=Py=0.5 mm

Ls=10.5 mm

R(E1)=0 degree

R(E2)=180 degrees

The above numerical values were determined in accordance with the design concept explained below.

First, fluorescent substances and electron-emitting devices for use in this display panel were selected.

Specifically, a fluorescent material P-22 which is superior in light-emitting efficiency and color purity was employed as the fluorescent substance, and a surface conduction electron-emitting device which is superior in electron-emitting efficiency and easy to manufacture was employed as the electron-emitting device.

Then, driving conditions necessary for achieving a maximum luminance, which is required for a capability of the display panel, were determined.

For example, assuming that the maximum luminance is set to 100 $Cd/m^2$, the electric power to be supplied to the fluorescent substance P-22 per unit area is calculated as 39

$W/m^2$ on condition that the light-emitting efficiency of the fluorescent substance is 8 lm/W. Following this calculation, the voltage Va [V] to be applied to the fluorescent substance and the voltage applied to the surface conduction electron-emitting device were determined. Specifically, on condition of Va=5 kV, it is required to irradiate electron beams of $7.8\times10^{-3}$ $A/m^2$ to the fluorescent substance per unit area from the surface conduction electron-emitting devices. The number of surface conduction electron-emitting devices per unit area is set to $4\times10^6$ devices/$m^2$ in accordance with the pixel pitches. But since the surface conduction electron-emitting devices are driven by scanning them in units of row, an electron beam output of $3.9\times10^{-6}$ A per device is required to achieve the maximum luminance. In view of that, the surface conduction electron-emitting device capable of outputting an electron beam with the above intensity was designed and the drive voltage Vf [V] of the device was set to 20 V.

The distance Lh between the fluorescent substance and the electron source substrate was set to 40 mm so as to be endurable against a voltage of 5 kV.

The above driving conditions were put into the equations [1] and [2] to calculate Ls. The resulting Ls=10.5 mm could be judged as a distance enough to solve the problem in the prior art, and hence it was employed as a design value. If the value of Ls were judged to be not sufficient, the parameters such as Va, Vf, Lh and design values of the surface conduction electron-emitting device would be set again to properly design the display panel so that Ls would have a sufficiently large value.

Structure and Manufacture Process of Display Panel

The structure and manufacture process of the display panel shown in FIG. 18 will be described below.

In FIG. 18, 1005 is a rear plate, 1006 is a side plate, and 1007 is a face plate. These members 1005 to 1007 jointly make up a hermetic container for maintaining a vacuum inside the display panel. When assembling the hermetic container, the joined portions between the constituent members must be sealed off to ensure a sufficient degree of strength and air tightness. This sealing-off was achieved by, by way of example, applying frit glass to the joined portions, and then baking the assembly in the atmosphere or nitrogen gas at 400° C. to 500° C. for 10 minutes or more. The method of evacuating the interior of the hermetic container will be described later.

Electron source substrates E1 and E2 are fixed to the rear plate 1005. On each of the electron source substrates, a number (N/2)×M of surface conduction electron-emitting devices are formed and wired into a matrix pattern using row-directional wirings 1003 and column-directional wirings 1004. If the electron source substrates E1 and E2 are referred together to as a multi-electron beam source, the multi-electron beam source includes a number N×M of surface conduction electron-emitting devices. Although FIG. 18 is simplified for the convenience of drawing, a very large number of surface conduction electron-emitting devices are in fact formed depending on applications of the display panel. In the case of the display panel for a high-quality TV, for example, N and M are preferably not less than 3000 and 1000, respectively. In this Example, N=3072 and M=1024 were set.

This display panel employed planar- or step-type surface conduction electron-emitting devices which will be described later in detail.

Figure 19:
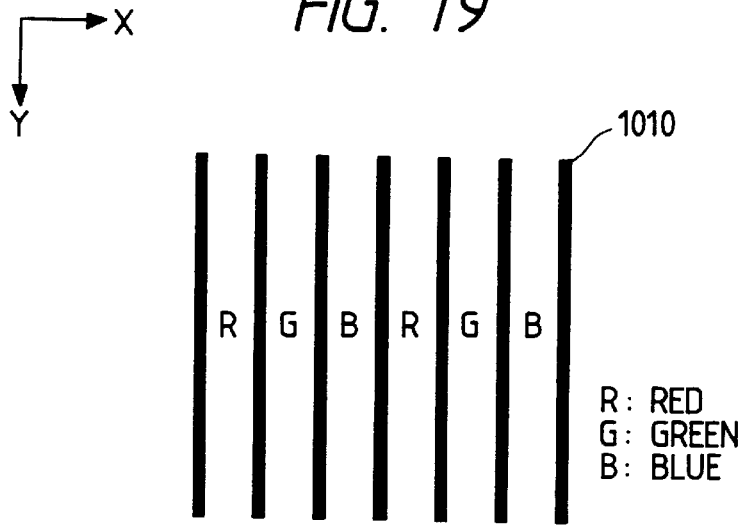
FIG. 19 is a plan view showing an arrangement of fluorescent substances on a face plate of the display panel.

A fluorescent film 1008 is formed on a lower surface of the face plate 1007. Since this Example concerns a color display apparatus, the fluorescent film 1008 comprises fluorescent substances in three primary colors, i.e., red, green and blue, which are usually used in the field of CRTs and are coated separately from each other. As shown in FIG. 19, for example, the fluorescent substances in respective colors are coated into a striped pattern with black conductors 1010 disposed between stripes of the fluorescent substances. The purposes of providing the black conductors 1010 are to eliminate an offset of the displayed color even if the positions irradiated by electron beams are slightly offset, to suppress reflection of exterior light for preventing a reduction in contrast, and to prevent the fluorescent film from being charged up with electron beams. A material containing graphite as a primary ingredient was employed as the black conductors 1010, but any other material which are achieve the above purposes may also be used.

When manufacturing a monochrome display panel, a monochrome fluorescent substance is only required to be coated to form the fluorescent film 1008. The black conductors are not necessarily used.

On the surface of the fluorescent film 1008 facing the rear plate, a metal back 1009, which is well known in the field of CRTs, is disposed. The purposes of providing the metal back 1009 are to increase a rate of light utilization by mirror-reflecting part of the light emitted from the fluorescent film 1008, to protect the fluorescent film 1008 from collisions with negative ions, to serve as an electrode for applying an electron beam accelerating voltage, and to serve as a guide path for electrons after exciting the fluorescent film 1008. The metal back 1009 was fabricated by a method of, after forming the fluorescent film 1008 on the face plate 1007, smoothing the surface of the fluorescent film and then depositing Al thereon by vacuum deposition. Note that when the fluorescent film 1008 is formed of a fluorescent material for low voltage, the metal back 1009 is not needed.

Though not used in this Example, a transparent electrode made of e.g., ITO may be provided between the face plate 1007 and the fluorescent film 1008, aiming to apply accelerating voltage and to increase conductivity of the fluorescent film 1008.

Denoted by Dx1 to Dxm, D'x1 to D'xm, Dy1 to Dyn, and Hv are terminals for electrical connection of the hermetic structure adapted to electrically connect the display panel and an electric circuit (not shown). Dx1 to Dxm and D'x1 to D'xm are electrically connected to the row-directional wirings 1003 of the multi-electron beam source, Dy1 to Dyn are to the column-directional wirings 1004 of the multi-electron beam source, and Hv is to the metal back 1009 of the face plate.

For creating a vacuum inside the hermetic container, after assembling the hermetic container, an evacuation tube and a vacuum pump (both not shown) are connected to the container and the interior of the container is evacuated to a vacuum degree of about $10^{-7}$ Torr. Then, the evacuation tube is sealed off. To maintain the desired vacuum degree in the hermetic container, a gettering film (not shown) is formed at a predetermined position in the hermetic container immediately before or after the sealing-off. The gettering film is a film formed by heating and depositing a gettering material, which contains, e.g., Ba as a main ingredient, by a heater or high-frequency heating. The interior of the hermetic container is maintained at a vacuum degree of $1\times10^{-5}$ to $1\times10^{-7}$ Torr under an adsorbing action of the gettering film.

The basic structure and manufacture process of the display panel according to the present invention has been described above.

Construction, Manufacture Process and Characteristics of Electron-Emitting Device The surface conduction electron-emitting device used in the display panel of this Example will be described below. The inventors have found that a surface conduction electron-emitting device of the type having an electron-emitting region or its vicinity formed of a fine particle film is superior in electron-emitting characteristics and is easy to design and manufacture. It can be thus said that the above type of surface conduction electron-emitting device is optimum for use with a multi-electron beam source of image display apparatuses having a large-sized screen and a high luminance. In view of the above finding, the inventors have tried to fabricate a display panel using planar surface conduction electron-emitting devices formed with fine particle films, and obtained very good results. Also, very good results were obtained for a display panel fabricated using step-type surface conduction electron-emitting devices formed with fine particle films. Therefore, planar and step-type surface conduction electron-emitting devices formed with fine particle films will be described below in detail.

(Planar Surface Conduction Electron-Emitting Device)

A description will first be made of the construction and manufacture process of the planar surface conduction electron-emitting device.

Figure 20A:
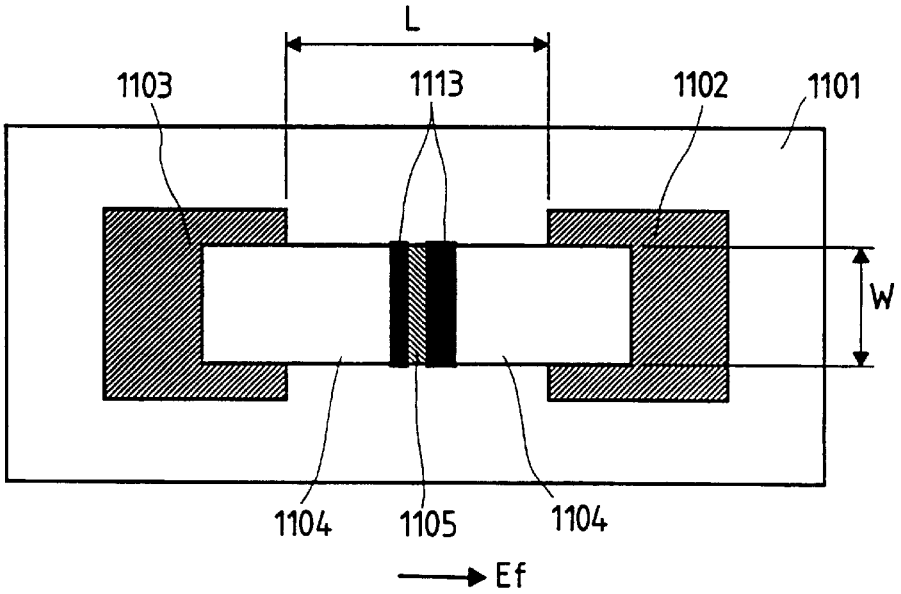
FIGS. 20A and 20B are plan and sectional views, respectively, of a planar-type surface conduction electron-emitting device used in the embodiment.
Figure 20B:
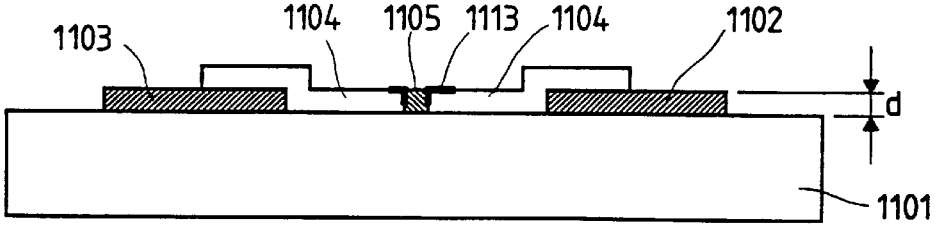

FIGS. 20A and 20B are a plan and sectional view, respectively, for explaining the construction of the planar surface conduction electron-emitting device. In these drawings, denoted by 1101 is a substrate, 1102 is a positive electrode, 1103 is a negative electrode, 1104 is a conductive thin film, 1105 is an electron-emitting region formed by the process of forming by energization, and 1113 is a thin film formed by the process of activating by energization.

The substrate 1101 may be any of various glass substrates made of, e.g., quartz glass and soda lime glass, various ceramic substrates made of, e.g., alumina, and those substrates having insulating layers made of, e.g., $SiO_2$ and laminated thereon.

The positive electrode 1102 and the negative electrode 1103 disposed on the substrate 1101 in opposite relation parallel to the substrate plane are each made of a material which has conductivity. The electrode material can be selected from, for example, metals such as Ni, Cr, Au, Mo, W, Pt, Ti, Cu, Pd and Ag or alloys thereof, metal oxides such as $In_2O_3$—$SnO_2$, and semiconductors such as polysilicon. The electrodes can be easily formed by, e.g., combination of the filmforming technique such as vacuum deposition and the patterning technique such as photolithography and etching. However, the electrodes may be formed by using any other suitable method (e.g., printing).

The configurations of the positive electrode 1102 and the negative electrode 1103 are appropriately designed in conformity with the purpose of the electron-emitting device to be applied. Generally, the spacing L between both the electrodes is designed by selecting an appropriate value in the range of several hundreds angstroms to several hundreds microns. Above all, the preferable range for application to display apparatuses is from several microns to several tens microns. The thickness d of each electrode is usually set to an appropriate value in the range of several hundreds angstroms to several microns.

The conductive thin film 1104 comprises a fine particle film. The term "fine particle film" used herein means a film comprising a number of fine particles (including their aggregations in an island state) as constituent elements. Looking at the fine particle film microscopically, the structure in which individual fine particles are dispersed away from each other, or adjacent to each other, or overlapped with each other is generally observed.

The size of fine particles used for the fine particle film is in the range of several angstroms to several thousands angstroms, preferably 10 angstroms to 200 angstroms. Also, the thickness of the fine particle film is properly set in consideration of various conditions; i.e., conditions required to achieve good electrical connection to the electrodes 1102 and 1103, conditions required to conduct the forming by energization (described later) in a satisfactory manner, and conditions required to maintain electric resistance of the fine particle film itself at an appropriate value (described later). Specifically, the thickness of the fine particle film is set to fall in the range of several angstroms to several thousands angstroms, more preferably 10 angstroms to 500 angstroms.

A material used to form the fine particle film can be suitably selected from, for example, metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge, and carbon.

The conductive thin film 1104 is formed of a fine particle film as described above, and its sheet resistance value is set to fall in the range of $10^3$ to $10^7$ ohms/□.

Since the conductive thin film 1104 is desired to establish satisfactory electrical connection to the positive electrode 1102 and the negative electrode 1103, the thin film and the electrode are partly overlapped with each other. In this Example shown in FIGS. 20A and 20B, the substrate, the positive and negative electrodes, and the conductive thin film are laminated in this order from below so as to provide the overlapped structure. In some cases, the substrate, the conductive thin film, and the positive and negative electrodes may be laminated in this order from below.

The electron-emitting region 1105 is a fissured portion formed in part of the conductive thin film 1104, and has higher resistance than the conductive thin film surrounding it in terms of electrical properties. The fissure is created by subjecting the conductive thin film 1104 to the process of forming by energization (described later). Fine particles having the size in the range of several angstroms to several hundreds angstroms may be dispersed in the fissure. Note that the position and shape of the electron-emitting region are schematically illustrated in FIGS. 20A and 20B because of difficulties in drawing the actual ones precisely and exactly.

The thin films 1113 are each a thin film made of carbon or carbon compounds, and are positioned so as to partly cover the electron-emitting region 1105 and the vicinity thereof. The thin films 1113 are formed by the process of activating by energization (described later) conducted after the process of forming by energization.

The thin films 1113 are made of any of single-crystal carbon, polycrystalline carbon and amorphous carbon, or a mixture thereof. The film thickness is selected to be not larger than 500 angstroms, more preferably not layer than 300 angstroms.

Note that the positions and shape of the thin films 1113 are schematically illustrated in FIGS. 20A and 20B because of difficulties in drawing the actual ones precisely and exactly. Incidentally, in the device shown in the plan view of FIG. 20A, the thin films 1113 are partly removed.

While the preferable basic construction of the device has been described above, the device used in this Example was designed as follows.

The substrate 1101 was formed of a soda lime glass, and the positive and negative electrodes 1102, 1103 were each formed of an Ni thin film. The electrode thickness d was set to 1000 angstroms and the electrode spacing L was set to 2 microns.

The fine particle film was formed of Pd or PdO as a primary material, and was coated to have a thickness of about 100 angstroms and a width of 100 microns.

Next, a preferable manufacture process for the planar surface conduction electron-emitting device will be described below.

FIGS. 21A to 21E are sectional views for explaining successive manufacture steps of the surface conduction electron-emitting device. In these drawings, the component members are denoted by the same reference numerals as used in FIGS. 20A and 20B.

Figure 21A:
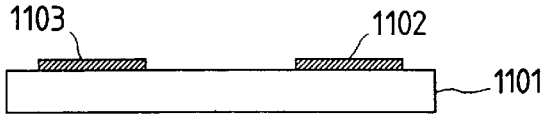
FIGS. 21A to 21E are sectional views showing successive manufacture steps of the planar-type surface conduction electron-emitting device.

1) First, as shown in FIG. 21A, the positive and negative electrodes 1102, 1103 are formed on the substrate 1101.

Prior to forming the electrodes, the substrate 1101 is sufficiently washed with a detergent, pure water and an organic solvent. An electrode material is then deposited on the substrate (by any of vacuum film-forming techniques such as vacuum deposition and sputtering). The deposited electrode material is then patterned by photolithography and etching to form the pair of electrodes (1102 and 1103) shown in FIG. 21A.

Figure 21B:
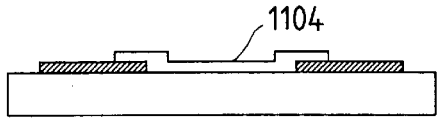

2) Next, the conductive thin film 1104 is formed as shown in FIG. 21B.

To form the conductive thin film 1104, an organic metal solution is coated and dried over the substrate shown in FIG. 21A, and then subjected to a heating/baking process to form a fine particle film. Thereafter, the fine particle film is patterned by lithography and etching into a predetermined shape. Here, the organic metal solution is a solution of an organic metal compound containing, as a primary element, a material of fine particles used to form the conductive thin film. (Specifically, Pd was used in this Example as a primary element. The solution was coated by dipping of the substrate in this Example, but it may be coated by any other suitable method such as spinning or spraying.)

Rather than coating an organic metal solution as carried out in this Example, the conductive thin film comprising a fine particle film may be formed by any other suitable method such as vacuum deposition, sputtering, or chemical vapor-phase deposition.

Figure 21C:
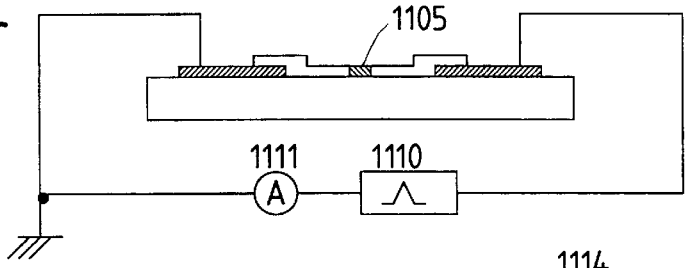

3) Subsequently, as shown in FIG. 21C, an appropriate voltage is applied between the positive and negative electrodes 1102, 1103 from a forming power supply 1110 to carry out the process of forming by energization so that the electron-emitting region 1105 is formed.

Here, the process of forming by energization means a process of energizing the conductive thin film 1104 formed of a fine particle film to properly destroy, deform or denature part of the film 1104 for transformation into the structure suitable for emitting electrons. In a portion of the conductive thin film formed of a fine particle film which has been transformed into the structure suitable for emitting electrons (i.e., in the electron-emitting region 1105), there produces an appropriate fissure. As compared with the state prior to formation of the electron-emitting region 1105, the electric resistance measured between the positive and negative electrodes 1102, 1103 is much increased in the state after formation thereof.

Figure 22:
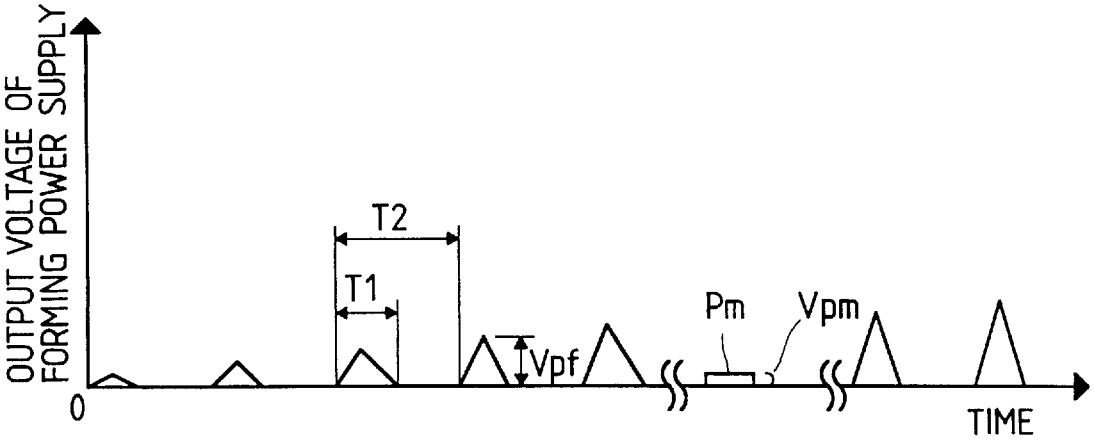
FIG. 22 is a graph showing waveforms of voltages applied in the process of forming by energization.

To describe the energizing method in more detail, FIG. 22 shows one example of voltage waveforms suitably applied from the forming power supply 1110. When subjecting the conductive thin film formed of a fine particle film to the process of forming by energization, it is preferable to apply a pulse-like voltage. In this Example, as shown in FIG. 22, a triangular pulse having a pulse width T1 was applied successively with a pulse interval T2. At this time, a peak value Vpf of the triangular pulse was raised gradually. Further, a monitor pulse Pm for monitoring the situation of the electron-emitting region 1105 being formed was inserted among the triangular pulses with a proper interval, and a current flowing upon application of the monitor pulse was measured by an ammeter 1111.

In this Example, under a vacuum atmosphere on the order of $10^{-5}$ Torr, the pulse width T1 was set to 1 millisecond, the pulse interval T2 was set to 10 milliseconds, and the peak value Vpf was raised at a rate of 0.1 V per pulse. Further, the monitor pulse Pm was inserted each time five triangular pulses were applied. In order to that the forming process is not adversely affected, a voltage Vpm of the monitor pulse was set to 0.1 V. Then, the energization for the forming process was terminated when the electric resistance between the positive and negative electrodes 1102, 1103 reached $1\times10^{6}$ ohms, i.e., when the current measured by the ammeter 1111 upon application of the monitor pulse was reduced down below $1\times10^{-7}$ A.

The above-described method is preferable for the surface conduction electron-emitting device of this Example. When the design of the surface conduction electron-emitting device is changed in, e.g., the material and thickness of the fine particle film or the electrode spacing L, it is desired that the energizing conditions be properly varied correspondingly.

Figure 21D:
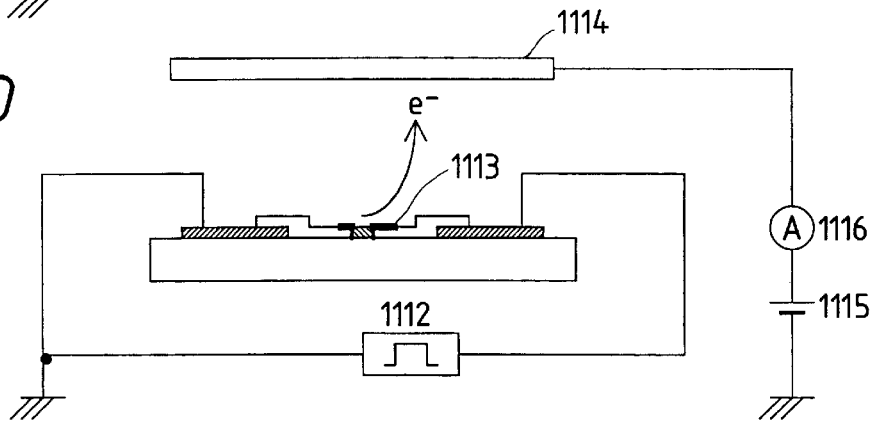

4) Then, as shown in FIG. 21D, an appropriate voltage is applied between the positive and negative electrodes 1102, 1103 from an activating power supply 1112 to carry out the process of activating by energization so that electron-emitting characteristics are improved.

Here, the process of activating by energization means a process of energizing the electron-emitting region 1105, which has been formed by the above process of forming by energization, to deposit carbon or carbon compounds in the vicinity of the region 1105. (In FIG. 21D, deposits of carbon or carbon compounds are schematically shown as the thin films 1113.) As compared with the state prior to process of activating by energization, an emission current at the same application voltage can be typically increased 100 times or more in the state after the activating process.

Specifically, a voltage pulse is periodically applied to the electron-emitting region 1105 under a vacuum ranging from $10^{-4}$ to $10^{-5}$ Torr so that carbon and carbon compounds are deposited originating from organic compounds present in the vacuum atmosphere. The deposits 1113 are formed of any of single-crystal carbon, polycrystalline carbon and amorphous carbon, or a mixture thereof. The deposit thickness is selected to be not larger than 500 angstroms, more preferably not larger than 300 angstroms.

Figure 23A:
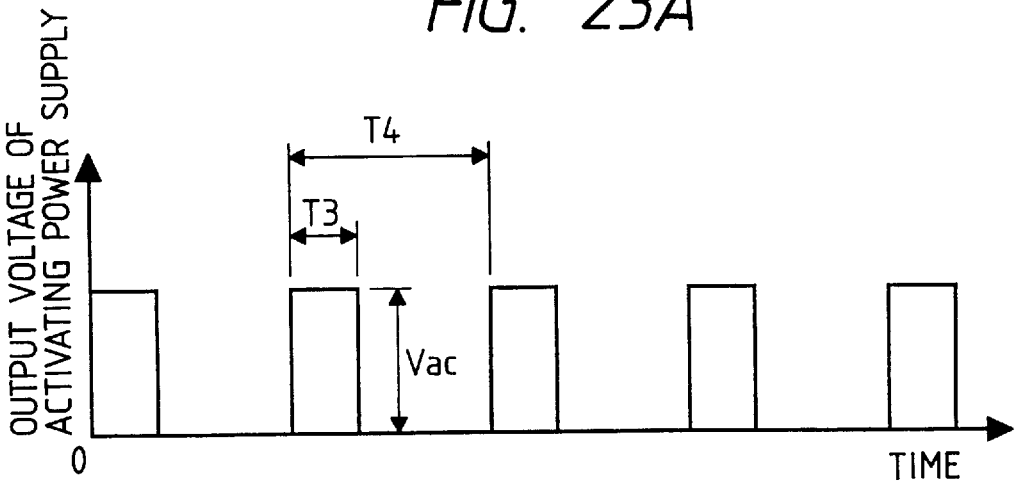
FIGS. 23A and 23B are graphs showing respectively a waveform of a voltage applied in the process of activating by energization and changes in an emission current Ie.

To describe the energizing method in more detail, FIG. 23A shows one example of voltage waveforms suitably applied from the activating power supply 1112. In this Example, the process of activating by energization was carried out by applying a constant voltage of rectangular waveform. Specifically, the voltage Vac of rectangular waveform was set to 14 V, the pulse width T3 was set to 1 millisecond, and the pulse interval T4 was set to 10 milliseconds. These energizing conditions are preferable for the surface conduction electron-emitting device of this Example. When the design of the surface conduction electron-emitting device is changed, it is desired that the energizing conditions by properly varied correspondingly.

Denoted by 1114 in FIG. 21D is an anode electrode for capturing an emission current Ie emitted from the surface conduction electron-emitting device. A DC high-voltage power supply 1115 and an ammeter 1116 is connected to the anode electrode 1114. (When the activating process is carried out after building the substrate 1101 into the display panel, the fluorescent film of the display panel is employed as the anode electrode.)

Figure 23B:
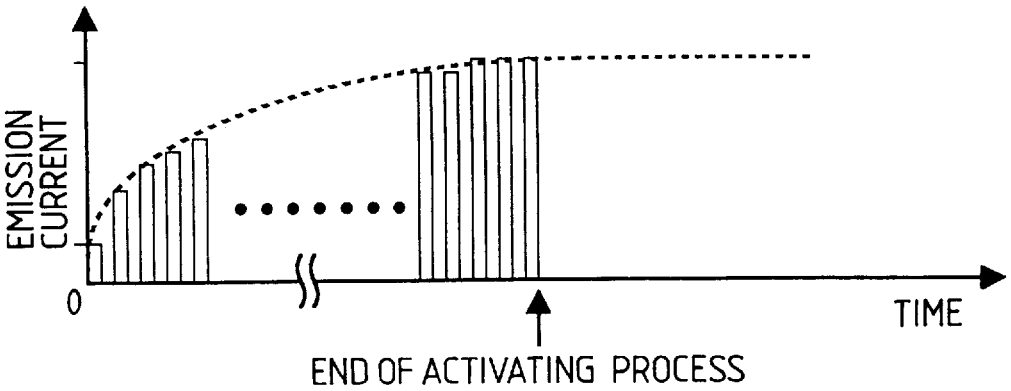

While the activating power supply 1112 is applying the pulse voltage to the device, the emission current Ie is measured by the ammeter 1116 to monitor the progress of the activating power supply 1112. FIG. 23B shows one example of the emission current Ie measured by the ammeter 1116. As shown, when the activating power supply 1112 starts to apply the pulse voltage, the emission current Ie is increased over time, but it is saturated so as not to further increase after a certain period of time. At the time the emission current Ie is substantially saturated, the activating power supply 1112 stops applying the pulse voltage and the process of activating by energization is ended.

These energizing conditions are preferable for the surface conduction electron-emitting device of this Example. When the design of the surface conduction electron-emitting device is changed, it is desired that the energizing conditions be properly varied correspondingly.

Figure 21E:
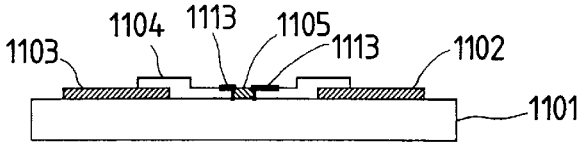

Eventually, the planar surface conduction electron-emitting device shown in FIG. 21E was manufactured.

(Step-type Surface Condition Electron-Emitting Device)

A description will now be made of another typical construction of the surface conduction electron-emitting device of the type having an electron-emitting region or its vicinity formed of a fine particle film, i.e., the construction of a step-type surface conduction electron-emitting device.

Figure 24:
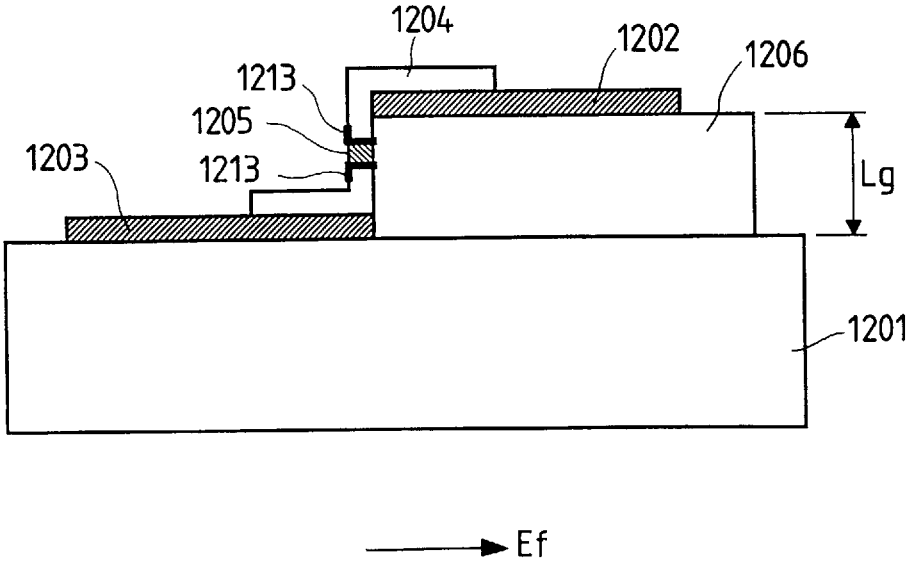
FIG. 24 is a sectional view of a step-type surface conduction electron-emitting device used in the embodiment.

FIG. 24 is a schematic sectional view for explaining the basic construction of the step-type surface conduction electron-emitting device. In the drawing, denoted by 1201 is a substrate, 1202 is a positive electrode, 1203 is a negative electrode, 1204 is a conductive thin film comprising a fine particle film, 1205 is an electron-emitting region formed by the process of forming by energization, and 1213 is a thin film formed by the process of activating by energization.

The step-type device is different from the above-described planar device in that the positive electrode 1202 is disposed on a step forming member 1206 and the conductive thin film 1204 covers a side face of the step forming member 1206. Therefore, the electrode spacing L in the planar device of FIG. 20A is set as a step height Lg of the step forming member 1206 in the step-type device. The suitable 1201, the positive electrode 1202, the negative electrode 1203, and the conductive thin film 1204 comprising a fine particle film can be formed by using any of the materials cited above in the description of the planar device. The step forming member 1206 is formed of, e.g., an electrically insulating material such as $SiO_2$.

The manufacture process of the step-type surface conduction electron-emitting device will be described below. FIGS. 25A to 25F are sectional views for explaining successive manufacture steps. In these drawings, the component members are denoted by the same reference numerals as used in FIG. 24.

Figure 25A:
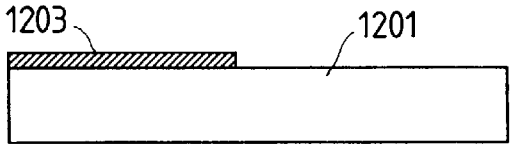
FIGS. 25A to 25F are sectional views showing successive manufacture steps of the step-type surface conduction electron-emitting device.

1) First, as shown in FIG. 25A, the negative electrode 1203 is formed on the substrate 1201.

Figure 25B:
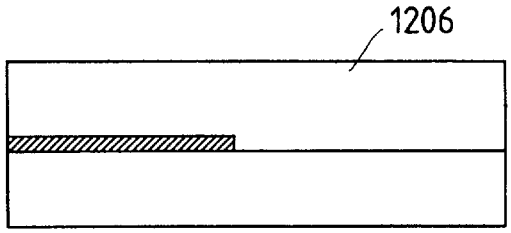

2) Then, as shown in FIG. 25B, an insulating layer used to form the step forming member is laminated thereon. The insulating layer is formed of $SiO_2$ by sputtering, for example. Any other suitable film-forming method such as vacuum deposition or printing may also be used instead.

Figure 25C:
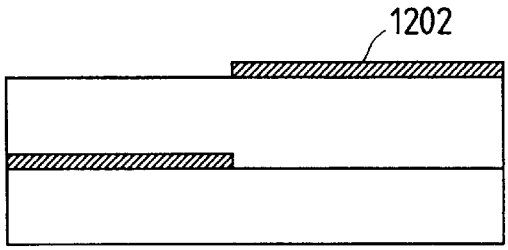

3) Then, as shown in FIG. 25C, the positive electrode 1202 is formed on the insulating layer.

Figure 25D:
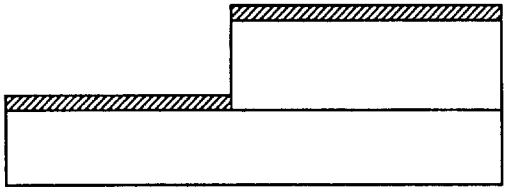

4) Then, as shown in FIG. 25D, part of the insulating layer is removed by, e.g., etching to make the negative electrode exposed.

Figure 25E:
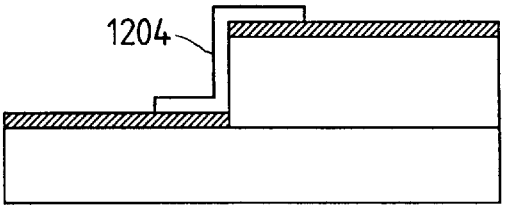

5) Then, as shown in FIG. 25E, the conductive thin film 1204 comprising a fine particle film is formed. Forming the conductive thin film 1204 is carried out by using the film-forming technique such as coating as with the case of the planar device.

6) Then, as with the case of the planar device, the process of forming by energization is carried out to form the electron-emitting region. (This forming process can be made in a similar manner as that described above with reference to FIG. 21C.)

7) Then, as with the case of the planar device, the process of activating by energization is carried out to deposit carbon or carbon compounds in the vicinity of the electron-emitting region. (This activating process can be made in a similar manner as that described above with reference to FIG. 21D.)

Figure 25F:
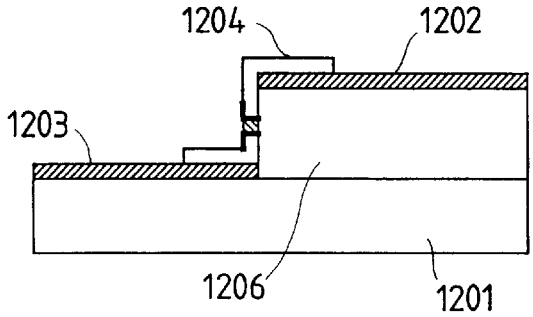

Eventually, the step-type surface conduction electron-emitting device shown in FIG. 25F was manufactured.

(Characteristics of Surface Conduction Electron-Emitting Device Used in Display Apparatus)

While the construction and manufacture processes of the planar- and step-type surface conduction electron-emitting devices have been described above, characteristics of these devices used in the display apparatus will be described below.

Figure 26:
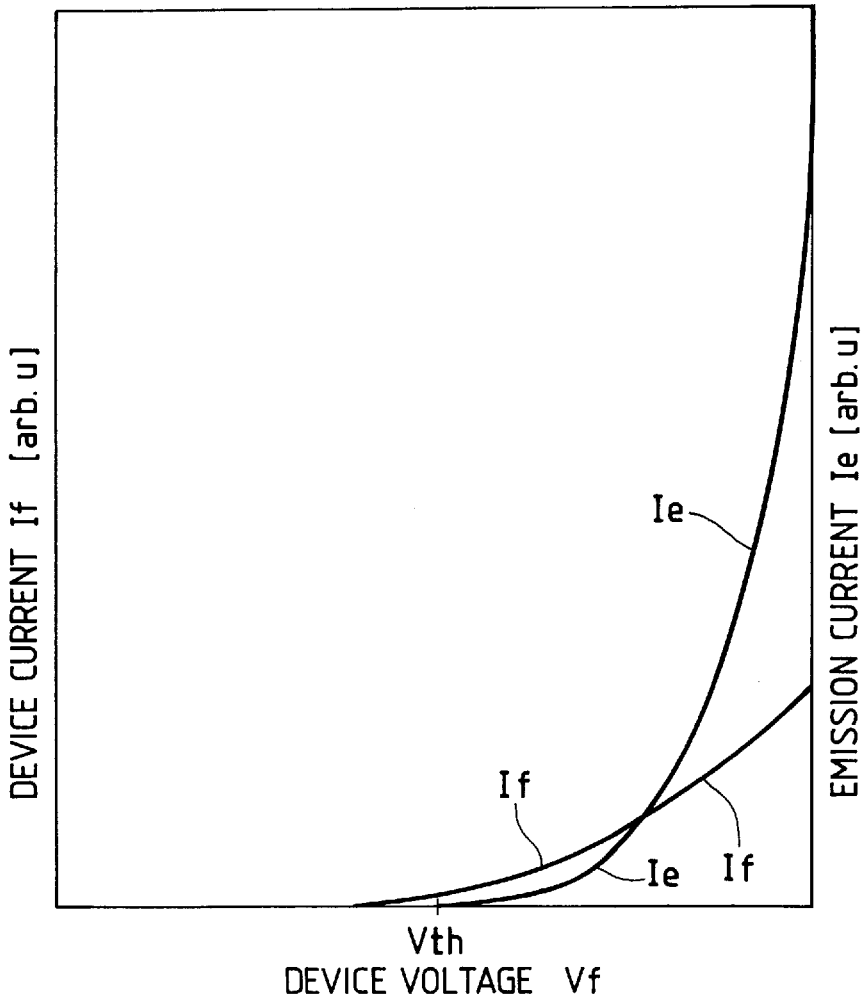
FIG. 26 is a graph showing typical characteristics of the surface conduction electron-emitting device used in the embodiment.

FIG. 26 shows typical examples of a characteristic of (emission current Ie) versus (device applied voltage Vf) and a characteristic of (device current If) versus (device applied voltage Vf) of the device used in the display apparatus. Note that two characteristic curves in the graph are plotted in arbitrary units because the emission current Ie is too much smaller than the device current If to depict them to the same scale and those characteristics are variable depending upon changes in the design parameters such as the size and shape of the device.

The electron-emitting device used in the display apparatus has the following three characteristics with respect to the emission current Ie.

First, the emission current Ie is abruptly increased when the device voltage applied exceeds a certain value (called a threshold voltage Vth), but it is not appreciably detected below the threshold voltage Vth.

Thus, the device is a non-linear device having the definite threshold voltage Vth with respect to the emission current Ie.

Secondly, the emission current Ie varies depending upon the device voltage Vf and, therefore, its magnitude can be controlled by the device voltage Vf.

Thirdly, since the current Ie is emitted from the device at a high response speed with respect to the voltage Vf applied to the device, the amount of electron charges emitted from the device can be controlled with the time during which the device voltage Vf is applied.

Because of having the above characteristics, the surface conduction electron-emitting device could be satisfactorily used in the display apparatus. By utilizing the first characteristic in the display apparatus which includes a number of surface conduction electron-emitting devices arranged corresponding to pixels, for example, an image can be displayed by sequentially scanning the display screen. Specifically, an appropriate voltage not less than the threshold voltage Vth corresponding to the desired luminance of emitted light is applied to the devices to be driven or selected, whereas a voltage less than the threshold voltage Vth is applied to the devices to be not selected. Then, the devices to be driven are changed over sequentially so that an image is displayed with the display screen scanned sequentially.

Also, by utilizing the second or third characteristic, the luminance of emitted light can be controlled so as to provide gradation display.

Structure of Electron Source Substrate

A description will now be made of the structure of an electron source substrate in which the above surface conduction electron-emitting devices are arrayed and wired into a simple matrix on a substrate.

Figure 27:
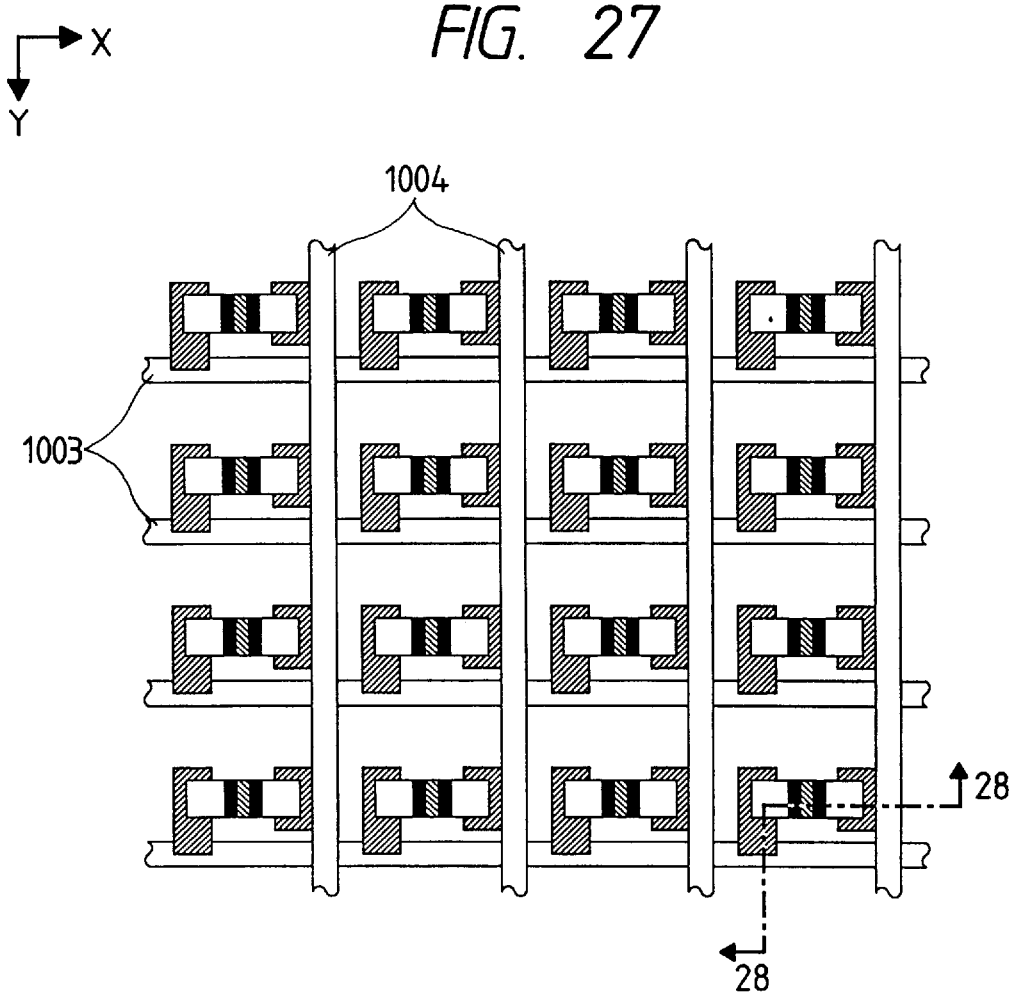
FIG. 27 is a plan view of an electron source substrate used in the embodiment.

FIG. 27 is a plan view of the electron source substrate E1 used in the display panel of FIG. 18. On a substrate 1001 (see FIG. 28), there are arrayed surface conduction electron-emitting devices which are each the same as shown in FIGS. 20A and 20B and are wired into a simple matrix using row-directional wirings 1003 and column-directional wirings 1004. At intersects between the row-directional wirings 1003 and the column-directional wirings 1004, insulating layers (not shown) are formed therebetween to keep both the wirings electrically insulated from each other.

Figure 28:
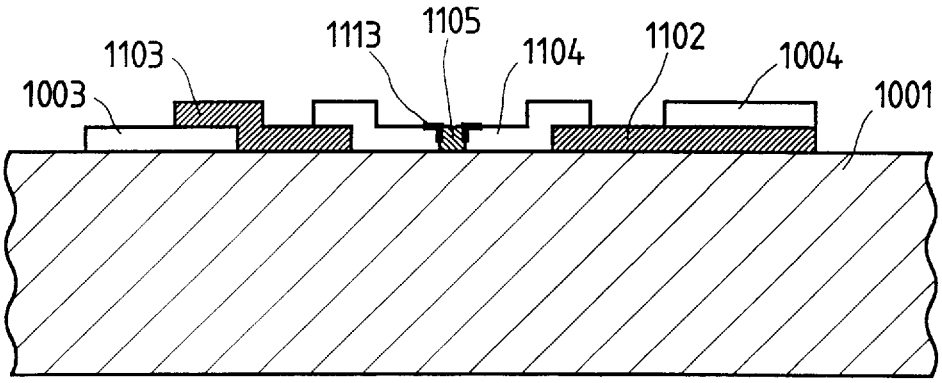
FIG. 28 is a partial sectional view of the electron source substrate used in the embodiment.

FIG. 28 shows a section taken along line 28—28 in FIG. 27.

The electron source substrate E1 of such a structure was manufactured by first forming the row-directional wirings 1003, the column-directional wirings 1004, the insulating layers (not shown) between the both the wirings, and the electrodes and conductive thin films of the surface conduction electron-emitting devices on the substrate 1001, and then energizing the devices through the row-directional wirings 1003 and the column-directional wirings 1004 to carry out the forming process and the activating process by energization.

Driving Method of Display Panel

Figure 29:
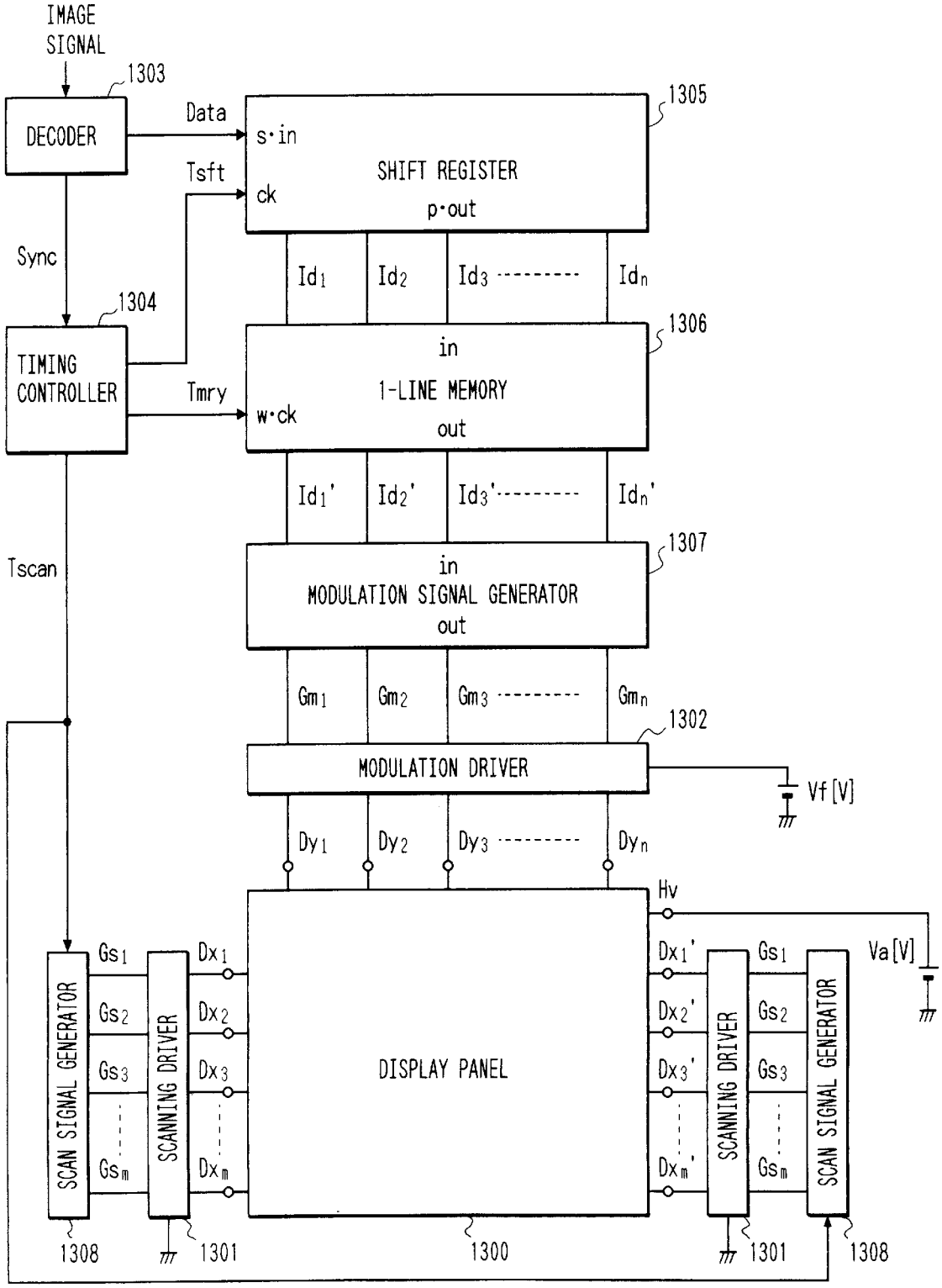
FIG. 29 is a block diagram of a drive circuit for the display panel of the embodiment.
Figure 30:
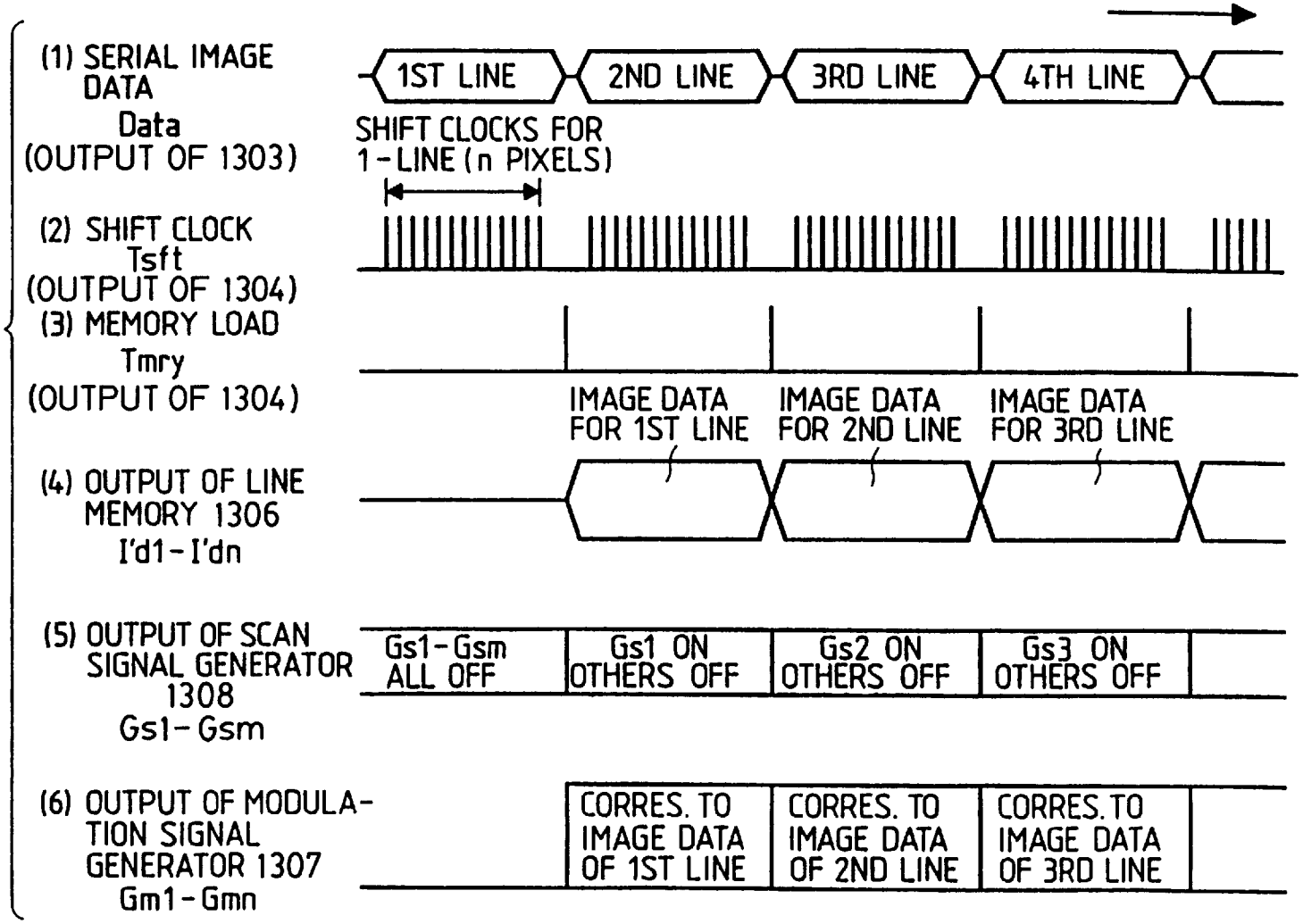
FIG. 30 is a timing chart showing an operation sequence of the drive circuit in the embodiment.

A method of display an image by the display panel of FIG. 18 will be described below with reference to FIGS. 29 and 30. FIG. 29 is a block diagram of an electric circuit and FIG. 30 is a timing chart showing operation of the electric circuit.

In FIG. 29, denoted by 1300 is a display panel being the same as shown in FIG. 18, 1301 is a scanning driver, 1302 is a modulation driver, 1303 is a decoder, 1304 is a timing controller, 1305 is a shift register, 1306 is a 1-line memory, 1307 is a modulation signal generator, 1308 is a scan signal generator, and Va and Vf are power supplies.

Operations of the above parts will be described below along a signal flow.

First, an image signal (such as a TV signal) is usually time-serially input to the decoder 1303 from the outside.

Then, the externally supplied image signal is separated by the decoder 1303 into a synch signal Sync and an image data Data which are output respectively to the timing controller 1304 and the shift register 1305. (More specifically, the synch signal Sync comprises a horizontal synch signal as a synch signal for each line of an image and a vertical synch signal as a synch signal for each frame of the image, but both the synch signals are referred together to as synch signal Sync for the convenience of description. Also, the image data Data consists of three components in three primary colors RGB in the case of a color image signal, but these component signals are referred together to as data signal Data for the convenience of description.)

The timing controller 1304 generates various timing control signals for matching the timed relationship among operations of the parts of the display apparatus based on the synch signal Sync.

Specifically, the timing controller 1304 outputs to the shift register 1305 a shift clock Tsft for sampling image data for one line (=n pixels) of the display panel and carrying out serial/parallel conversion of the sampled data. In a timing chart of FIG. 30, Data and Tsft are illustrated respectively at (1) and (2).

The data (Id1 to Idn) for each line of the image after the serial/parallel conversion are accumulated in the line memory 1306 in accordance with a memory load timing control signal Tmry output from the timing controller 1304. In the timing chart of FIG. 30, the memory load timing control signal Tmry and output signals (I'd1 to I'dn) of the line memory 1306 are illustrated respectively at (3) and (4).

The modulation signal generator 1307 generates modulation signals Gm1 to Gmn in accordance with the output signals (I'd1 to I'dn) of the line memory 1306. In this Example, the modulation signal generator 1307 employs a pulse width modulating method by which a pulse duration is modulated in accordance with the image data.

Timings of the modulation signals Gm1 to Gmn are shown at (6) in FIG. 30.

The modulation driver 1302 generates pulse signals which each have a voltage Vf [V] and are controlled in accordance with the modulation signals Gm1 to Gmn. These pulse signals are applied to the column-directional wirings of the electron source substrate through the feed terminals Dy1 to Dyn of the display panel. (In this Example, Vf is set to 20 V).

On the other hand, the timing controller 1304 also generates a control signal Tscan for scanning the multi-electron beam source in the display panel 1300 and outputs it to the scan signal generator 1308. In this Example, the scan signal generator 1308 and the scanning driver 1301 are provided for each of the two electron source substrates in the display panel independently of each other, but they are operated at the same timing.

The scan signal generator 1308 generates scan signals Gsl to Gsm in accordance with the control signal Tscan. The states of the scan signals Gs1 to Gsm are shown at (5) in FIG. 30. In response to the scan signals shown as being on there, the scanning driver 1301 supplies a ground level, i.e., 0 V, to the corresponding feed terminals. Thus, scan pulses of 0 V are applied to the row-directional wirings of the electron source substrate through the feed terminals Dx1 to Dxm and Dx1' to Dxm' of the display panel.

Further, a DC voltage of 5 kV is output from the power supply Va and is applied to fluorescent substances in the display panel 1300 through the feed terminal Hv.

The driving method of the display panel 1300 has been described above.

EXAMPLE 2

Another Example embodying the first measure of the present invention will be described below in connection with a display apparatus using four electron source substrates.

As the array of pixels, the structure and manufacture process of a display panel, the construction, manufacture process and characteristics of an electron-emitting device, the structure of the electron source substrates, and the driving method of the display panel are principally the same as in above Example 1, these items are not described here.

The arrangement of electron-emitting devices in this Example 2 will be described with reference to FIG. 13B.

In this Example 2, surface conduction electron-emitting devices are arranged as follows:

Px=Py=0.5 mm

Lsx=Lsy=7.5 mm

R(E3)=45 degrees

R(E4)=315 degrees

R(E5)=135 degrees

R(E6)=225 degrees

The following conditions were the same as in Example 1:

Va=5 kV

Vf=20 V

Lh=40 mm

EXAMPLE 3

Still another Example embodying the first measure of the present invention will be described below in connection with a display apparatus using six electron source substrates.

As the array of pixels, the structure and manufacture process of a display panel, the construction, manufacture process and characteristics of an electron-emitting device, the structure of the electron source substrates, and the driving method of the display panel are principally the same as in above Example 1, these items are not described here.

The arrangement of electron-emitting devices in this Example 3 will be described with reference to FIG. 13C.

In this Example 3, surface conduction electron-emitting devices are arranged as follows:

Px=Py=0.5 mm

Lsx=4.9 mm $Lsy_1$=5.5 mm $Lsy_2$=10.5 mm

R(E7)=30 degrees

R(E8)=330 degrees

R(E9)=90 degrees

R(E10)=270 degrees

R(E11)=150 degrees

R(E12)=210 degrees

The following conditions were the same as in Example 1:

Va=5 kV

Vf=20 V

Lh=40 mm

EXAMPLE 4

Still another Example embodying the first measure of the present invention will be described below in connection with a display apparatus using eight electron source substrates.

As the array of pixels, the structure and manufacture process of a display panel, the construction, manufacture process and characteristics of an electron-emitting device, the structure of the electron source substrates, and the driving method of the display panel are principally the same as in above Example 1, these items are not described here.

The arrangement of electron-emitting devices in this Example 4 will be described with reference to FIG. 13D.

In this Example 4, surface conduction electron-emitting devices are arranged as follows:

Px=Py=0.5 mm $Lsx_3$=3.2 mm $Lsx_4$=3.9 mm $Lsy_3$=5.5 mm $Lsy_4$=9.9 mm

R(E13)=30 degrees

R(E14)=330 degrees

R(E15)=70 degrees

R(E16)=290 degrees

R(E17)=110 degrees

R(E18)=250 degrees

R(E19)=150 degrees

R(E20)=210 degrees

The following conditions were the same as in Example 1:

Va=5 kV

Vf=20 V

Lh=40 mm

EXAMPLE 5

An Example embodying the second measure of the present invention will be described below.

Describing details of parts of a display apparatus with reference to FIG. 4, field-emission electron-emitting devices were used as the electron-emitting devices 1 and the respective were set as follows:

Px=PAx=PBx=0.5 mm

Lh=40 mm

Ldx=127 mm

Ldz=38 mm

Ls=4.5 mm

The voltage Va applied to the fluorescent substances 13 and the voltage Vdef applied to the deflecting electrodes were set as follows:

Va=5 kV

Vdef=840 V

Advantages

According to the present invention, as fully described hereinabove, when a plurality of electron source substrates are combined with each other to realize a display apparatus having a large-sized screen, electron beams are deviated a proper distance toward the boundary between the electron source substrates.

As a result, a display incapable region which has been the problem in the prior art can be prevented from appearing at the substrate boundary. The display apparatus having a large-sized screen provided by the present invention is superior in image quality, and hence its use in domestic and industrial fields is highly valuable.

What is claimed is:

1. An image display apparatus comprising:

a plurality of electron-emitting devices arrayed on a plurality of substrates that are arranged side by side;

an image-forming member for forming an image upon irradiation of electron beams emitted from said electron-emitting devices; and deviating means for deviating the electron beams emitted from said electron-emitting devices, said deviating means deviating said electron beams toward boundaries between said substrates, wherein the plurality of substrates arranged side by side are combined at the boundaries and the distance between the electron devices sandwiching the boundaries is larger than an array pitch of the electron-emitting devices within each of the substrates.

2. An image display apparatus according to claim 1, wherein each of said substrates has a plurality of electron-emitting devices arrayed thereon, and said deviating means deviates electron beams emitted from said plurality of electron-emitting devices arrayed on the same substrate in the same direction.

3. An image display apparatus according to claim 1, wherein said electron emitting device is an electron emitting device comprising a negative electrode, an electron-emitting region and a positive electrode formed side by side on a surface of said substrate, said electron-emitting region being between the negative electrode and the positive electrode.

4. An image display apparatus according to claim 3, wherein said electron-emitting device has the positive electrode positioned nearer to the boundary between said substrates than the electron-emitting region.

5. An image display apparatus according to claim 4, wherein said deviating means includes voltage applying means for applying a voltage to each of said electron-emitting device and said image-forming member.

6. An image display apparatus according to claim 3, wherein said electron-emitting device is a surface conduction electron-emitting device.

7. An image display apparatus according to claim 3, wherein said electron-emitting device is a lateral field-emission electron-emitting device.

8. An image display apparatus according to claim 1, wherein said deviating means is a deflecting electrode disposed between said substrate and said image-forming member.

9. An image display apparatus according to claim 8, wherein said electron-emitting device is a field-emission electron-emitting device.

10. An image display apparatus according to claim 8, wherein said electron-emitting device is a surface conduction electron-emitting device.

11. An image display apparatus according to claim 8, wherein said electron-emitting device is an MIM electron-emitting device.

12. An image display apparatus according to claim 1, wherein said plurality of electron-emitting devices are wired into a matrix pattern using row-directional wirings and column-directional wirings.

13. An image display apparatus according to claim 1, wherein the wirings disposed on said plurality of substrates are electrically connected to each other at the boundary between said substrates.

14. An image display apparatus according to claim 1, wherein conductive members are disposed at the boundary between said substrates so as to extend from a side face of each of said substrates to the rear side thereof, and the wirings disposed on each of said plurality of substrates are each electrically connected to the corresponding conductive member.

15. An image display apparatus according to claim 1, wherein one of a plurality of pixels is assigned to each electron-emitting device.

16. An image display apparatus according to claim 3, wherein the deviating means has a power source for applying a voltage to the image-forming member.

17. An image display apparatus according to claim 4, wherein the following equations are satisfied:

$$Ls = Px + (2 \times Lef)$$

$$Lef = 2 \times K \times Lh \times \sqrt{(Vf/Va)}$$

where Ls is the distance in meters between the electron emitting devices sandwiching the boundaries, Px is the array pitch in meters of pixels in the X direction, Lef is the deviation in meters of the electron beams deviated toward the boundaries, Lh is the distance in meters between the electron-emitting devices and the image-forming member, Vf is the drive voltage in volts applied to the electron-emitting devices, Va is the voltage in volts applied to the image-forming member and K is a constant.

18. An image display apparatus according to claim 8, wherein he electron-emitting devices are semiconductor devices having a PN junction.

19. An image display apparatus according to claim 1, wherein the substrates are glass substrates.

20. An image display apparatus according to claim 1, wherein the substrates are semiconductor substrates.

* * * * *

UNITED STATES PATENT AND TRADEMARK OFFICE

CERTIFICATE OF CORRECTION

PATENT NO. : 5,838,097

DATED : November 17, 1998

INVENTOR(S) : YUJI KASANUKI ET AL.

It is certified that error appears in the above-identified patent and that said Letters Patent is hereby corrected as shown below:

ON THE TITLE PAGE

[73] Assignee, "Canon Kabushiki Kaisha" should read --Canon Kabushiki Kaisha, Tokyo,Japan--.

[56] REFERENCES CITED

USPD, insert --5,025,196 6/1991 Suzuki et al.--.

FPD, "0131332" should read --01-31332--.
"02257551" should read --02-257551--.
"0355738" should read --03-55738--.
"0428137" should read --04-28137--.

FPD, insert --0604975 7/1994 EPO
2682211 4/1993 France
5-094787 4/1993 Japan--.

OP, in "Electron...", "aned" should read --and--.

OP, in "Physical properties of thin-filmfield emission cathodes with molybdenum cones" should read --Physical Properties Of Thin-Film Field Emission Cathodes With Molybdenum Cones--.

UNITED STATES PATENT AND TRADEMARK OFFICE

CERTIFICATE OF CORRECTION

PATENT NO. : 5,838,097

DATED : November 17, 1998

INVENTOR(S) : YUJI KASANUKI ET AL.

It is certified that error appears in the above-identified patent and that said Letters Patent is hereby corrected as shown below:

COLUMN 1

Line 31, "(1975)," should read -- (1975)),--.
Line 33, "(1983)." should read --(1983)).--.

COLUMN 4

Line 49, "an" should read --a--.

COLUMN 10

Line 56, "degree." should read --degree,--.

COLUMN 13

Line 29, "airightness" should read --airtightness--.

COLUMN 16

Line 14, "mores" should read --more--.

COLUMN 19

Line 6, "may have" should read --, which may have--.
Line 20, "includes," should read --include,--.

UNITED STATES PATENT AND TRADEMARK OFFICE

CERTIFICATE OF CORRECTION

PATENT NO. : 5,838,097

DATED : November 17, 1998

INVENTOR(S) : YUJI KASANUKI ET AL.

It is certified that error appears in the above-identified patent and that said Letters Patent is hereby corrected as shown below:

COLUMN 22

Line 14, "are achieve" should read --achieves--.

COLUMN 23

Line 47, "filmforming" should read --film-forming--.

COLUMN 24

Line 56, "layer" should read --larger--.

COLUMN 26

Line 14, ""to" should be deleted.
Line 65, "by" should read --be--.

UNITED STATES PATENT AND TRADEMARK OFFICE

CERTIFICATE OF CORRECTION

PATENT NO. : 5,838,097

DATED : November 17, 1998

INVENTOR(S) : YUJI KASANUKI ET AL.

It is certified that error appears in the above-identified patent and that said Letters Patent is hereby corrected as shown below:

COLUMN 27

Line 46, "suitable" should read --substrate--.

COLUMN 34

Line 31, "he" should read --the--.

Signed and Sealed this

Twenty-fifth Day of January, 2000

*Attest:*

*Attesting Officer*

*Acting Commissioner of Patents and Trademarks*